US009694928B2

(12) United States Patent
McNestry

(10) Patent No.: US 9,694,928 B2
(45) Date of Patent: Jul. 4, 2017

(54) LABELLING MACHINE

(71) Applicant: VIDEOJET TECHNOLOGIES INC., Wood Dale, IL (US)

(72) Inventor: Martin McNestry, Derbyshire (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 14/645,144

(22) Filed: Mar. 11, 2015

(65) Prior Publication Data

US 2015/0210419 A1 Jul. 30, 2015

Related U.S. Application Data

(62) Division of application No. 13/057,327, filed as application No. PCT/GB2009/001961 on Aug. 10, 2009, now Pat. No. 9,038,685.

(30) Foreign Application Priority Data

Aug. 11, 2008 (GB) ..... 0814617.7

(51) Int. Cl.
*B65C 9/00* (2006.01)
*B65C 9/42* (2006.01)
(Continued)

(52) U.S. Cl.
CPC ..... *B65C 9/0006* (2013.01); *B65C 9/1865* (2013.01); *B65C 9/1892* (2013.01);
(Continued)

(58) Field of Classification Search
CPC ..... B21C 47/30; B65C 9/18; B65C 9/1803; B65C 9/1865; B65C 9/1892; B65C 9/40;
(Continued)

(56) References Cited

U.S. PATENT DOCUMENTS 3,815,839 A * 6/1974 Madachy ..... B21C 47/30 242/571.1
4,194,941 A 3/1980 Briggs
(Continued)

FOREIGN PATENT DOCUMENTS

CN 1960854 A 5/2005
DE 1761707 8/1970
(Continued)

OTHER PUBLICATIONS

European Patent Office, International Search Report for PCT/GB2009/001961, Mailed Jan. 27, 2010.
(Continued)

*Primary Examiner* — George Koch
(74) *Attorney, Agent, or Firm* — Robert L. Wolter; Beusse, Wolter, Sanks & Maire PLLC

(57) ABSTRACT

A labelling machine comprising a supply spool support (12) adapted to receive a supply spool (28), a takeup spool support (14) adapted to form a takeup spool (32) of web (30) from which at least some labels (74) have been removed, a motor (40) arranged to turn the takeup spool, and a controller to control operation of the motor. A web path (16) is defined between the supply spool and the take-up spool, and the controller is arranged to control the motor to turn the take-up spool so as to cause controlled predetermined linear movement of a web along the web path and onto the take-up spool, furthermore comprising a sensor (50) operable to sense linear displacement of the web and/or displacement of the web in a direction other than the direction of the web, a printer (34) movable between a first position and a second position, and a separator surface (24) comprising a first portion inclined relative to the web path.

12 Claims, 13 Drawing Sheets

(51) Int. Cl.

| | |
|---|---|
| ***B65C 9/18*** | (2006.01) |
| ***B65H 75/28*** | (2006.01) |
| ***B65H 19/28*** | (2006.01) |

(52) U.S. Cl.

CPC ..... *B65C 9/42* (2013.01); *B65H 19/28* (2013.01); *B65H 75/28* (2013.01); *B65C 2009/0009* (2013.01); *B65C 2009/0096* (2013.01); *Y10T 156/17* (2015.01)

(58) Field of Classification Search

CPC ..... B65C 9/42; B65C 9/46; B65C 2009/402; B65C 2009/404

USPC ..... 242/586, 586.4, 587.2; 156/361, 378, 156/538, 542, 556, DIG. 44, DIG. 45, 156/DIG. 46

See application file for complete search history.

(56) References Cited

U.S. PATENT DOCUMENTS

| | | | |
|---|---|---|---|
| 4,242,167 | A | 12/1980 | Hoffmann |
| 4,294,644 | A | 10/1981 | Anderson |
| 4,488,925 | A | 12/1984 | Craig |
| 4,516,208 | A | 5/1985 | Sakura |
| 4,561,926 | A | 12/1985 | Hamisch |
| 4,735,664 | A | 4/1988 | Asghar |
| 4,904,330 | A | 2/1990 | Vanderpool |
| 4,956,045 | A | 9/1990 | Goodwin |
| 5,370,754 | A | 12/1994 | Soloman |
| 5,556,492 | A | 9/1996 | Vonderhorst |
| 5,785,798 | A | 7/1998 | Horsman |
| 5,803,624 | A | 9/1998 | Miazga |
| 5,849,143 | A | 12/1998 | Ingalls |
| 5,888,343 | A | 3/1999 | Olson |
| 6,558,490 | B2 | 5/2003 | Klein |
| 6,645,327 | B2 | 11/2003 | Austin |
| 6,752,189 | B2 | 6/2004 | Oldenburg |
| 8,066,045 | B2 | 11/2011 | Sleiman |
| 2001/0054470 | A1 | 12/2001 | Firehammer |
| 2002/0084014 | A1 | 7/2002 | Klein |
| 2005/0061450 | A1 | 3/2005 | Petitti |
| 2006/0065371 | A1 | 3/2006 | Grabowski |
| 2006/0237125 | A1 | 10/2006 | Montgomery |
| 2007/0113986 | A1 | 5/2007 | Harte |
| 2007/0221319 | A1 | 9/2007 | Morgan |
| 2008/0303639 | A1 | 12/2008 | Ford |
| 2011/0048608 | A1 | 3/2011 | Dods |

FOREIGN PATENT DOCUMENTS

| | | |
|---|---|---|
| DE | 3739421 | 6/1989 |
| EP | 0085418 | 8/1984 |
| EP | 0347290 | 12/1989 |
| EP | 1679260 | 7/2006 |
| FR | 2619079 | 2/2004 |
| GB | 2064471 | 6/1981 |
| JP | S58004304 A | 6/1981 |
| JP | 2004203453 A | 7/2007 |
| NL | 1018446 | 7/2007 |

OTHER PUBLICATIONS

Machine Translation of EP0347290 A1, originally published in French on Jun. 9, 1989. Inventor: Jean-Michel Chapelle.

Apr. 12, 2013 Office Action Chinese Patent Application No. 200980131341.X.

* cited by examiner

LABELLING MACHINE

RELATED APPLICATIONS

This application is a Divisional of U.S. application Ser. NO. 13/057327 filed Feb. 3, 2011, now U.S. Pat. No. 9,038,685 which claims priority under 35 U.S.C. §371 from PCT Application No. PCT/GB2009/001961, filed in English on Aug. 10, 2009, which claims the benefit of Great Britain Application Serial No. 0814617.7 filed on Aug. 11, 2008, the disclosures of both of which are incorporated by reference herein in their entireties.

The present invention relates to labelling machines and particularly to labelling machines for use with webs carrying a plurality of labels. Such machines are sometimes referred to as "roll-fed self-adhesive labelling machines".

A web carrying labels is usually manufactured and supplied as a wound roll for convenience hereinafter referred to as a spool. For a given roll of labels, all the labels are typically the same size, within manufacturing tolerances.

Labels are commonly used to display information relating to an article and are disposed on the article such that the information is easily readable either manually or automatically. Such labels may, for example, display product information, barcodes, stock information or the like. Labels may be adhered to a product or to a container in which the product is packaged.

In the manufacturing industry, where such labels are read automatically, it is important for the information to be printed such that it is clear and positioned accurately so that an automated reader can consistently and correctly read the information.

It is known to print information onto labels immediately before printed labels are applied to a product or container. Such operations may be carried out by a device known as a print and apply labelling machine. It is desirable to be able to advance a web of labels to be applied to a product or container accurately, so as to ensure that print is accurately positioned on the label, and also to ensure that the label is accurately positioned on the product or container. This is particularly important in print and apply labelling machines in which printing is typically carried out while the label moves relative to the printhead, making accurate control of the label important if printing is to be properly carried out such that the desired information is correctly reproduced on the label.

Given that labels are often removed from the moving web by passing the web under tension around a relatively sharp 'peel plate', (also sometimes referred to as a 'peel beak' and generally referred to herein as a label separating beak), it is important to ensure that a predetermined optimum tension on the web is maintained. In some applications, it is also important that the web can be moved at a predetermined speed of travel along a defined web path, so as to ensure that the speed at which labels are dispensed is compatible with the speed at which products or containers move along a path adjacent the device.

For convenience the term "web" is herein used interchangeably to mean a web carrying labels and also to mean a web from which labels have been removed, the sense in each case being immediately apparent from the context.

A known labelling machine uses a capstan roller of known diameter which is accurately driven to achieve desired linear movement of the web. This capstan roller is also often referred to as a "drive roller". The web is often pressed against the capstan roller by a nip roller, in order to mitigate risk of slip between the capstan roller and the web. For the reliable running of such machines the nip/capstan mechanical arrangement is designed so as to ensure respective axes of the two rollers are substantially parallel to one another and that the pressure exerted by the nip roller (which is typically sprung loaded) is generally even across the width of the label carrying web. This often results in relatively expensive and complex mechanical arrangements, and it is often a time consuming process to load the machine with a supply spool of labels and feed the web from the supply spool to a take-up spool, through the nip/capstan rollers, before the labelling machine is operated. This is because the nip roller has to be temporarily disengaged or removed to allow the web to be positioned along the web path between the supply spool and the take up spool. The nip roller is then repositioned such that the web is pressed against the capstan roller by the nip roller and the web can be moved between the spools by rotation of the capstan roller.

Furthermore, in such labelling machines, the take-up spool itself typically needs to be driven in order to maintain adequate tension in the web, between the nip/capstan roller and the take-up spool. If the tension is too low, the web can become wrapped around the capstan roller, causing the machine to fail, and if the tension is too high, the capstan roller can be "over-driven" by the take-up spool, resulting in the web being fed at the wrong speed, or indeed the web snapping. The drive for the take-up spool must also deal with the changing diameter of the take-up spool which carries the web from which labels have been removed, the diameter of the take-up spool increasing from an initial value where the take-up spool is empty, to a value many times greater than the initial value, when the supply spool is exhausted.

Mechanisms for achieving this important take-up spool drive include so-called slipping clutch arrangements, where the take-up spool is either driven by an independent drive means, such as a variable torque motor, or driven via a pulley belt and gears from a motor driving the capstan roller.

Drive mechanisms which rely upon capstan rollers add cost and complexity to the labelling machine, and have the disadvantages referred to above.

Another known problem associated with nip/capstan roller arrangements of the type described above is that the pressure exerted by the nip roller onto the web and against the capstan roller can cause label adhesive to "bleed" out, over time, from the edges of the label. This adhesive can eventually build up on the capstan or nip rollers. This adhesive can then cause the web to stick to the rollers such that it is not transported properly along the desired web path. Furthermore, it is common for labels to be accidentally removed from the web and become attached to the capstan roller or nip roller, impeding proper operation of the labelling machine.

It is therefore desirable in the manufacturing industry for there to be means and a method for transporting a web and applying labels from the web to a product or container, which is accurate, reliable, simple to use and adaptable to different applications.

It is an object of embodiments of the present invention to obviate or mitigate one or more of the problems set out above.

According to a first aspect of the present invention, there is provided a labelling machine comprising: a supply spool support adapted to receive a supply spool of a web supporting a plurality of labels; a take-up spool support adapted to form a take-up spool of the web from which at least some labels have been removed; a motor arranged to turn the take-up spool; and a controller to control operation of the motor; wherein a web path is defined between the supply spool and the take-up spool, and the controller is arranged to control the motor to turn the take-up spool so as to cause controlled predetermined linear movement of a web along the web path and onto the take-up spool.

Thus, the first aspect of the present invention provides a labelling machine in which movement of a web is controlled by a motor arranged to turn the take-up spool. As such, there is no need for the provision of a capstan roller or other drive means along the web path. This makes the labelling machine relatively simple, particularly from the point of view of loading a web of labels into the labelling machine, and more reliable by avoiding at least some of the problems referred to above. Movement of the web may be caused solely by the motor turning the take up spool. As such, the take up spool may be accurately controlled to provide controlled linear movement of the web. A labelling machine in which control of linear web movement is not controlled by a capstan roller is provided by some aspects of the invention.

The motor may be arranged to turn the take-up spool support in order to turn the take-up spool.

The web typically supports a plurality of spaced apart labels, which are detachably attached to the web along its length.

The labelling machine may further comprise means for removing labels from the web as the web is transferred from the supply spool to the take up spool.

The labelling machine may further comprise a linear displacement sensor operable to sense linear displacement of a web along the web path and provide a signal indicative thereof. The controller may be operable to receive the signal indicative of displacement and control the motor based upon the received signal. The linear displacement sensor may be a contactless sensor. That is, the linear displacement sensor may be arranged to sense displacement of the web along the web path without contacting the web. The use of a contactless sensor is preferred in some applications given that minimising contact between the web and components of the labelling machine tends to improve reliability. For example, where the label face of the web contacts components of the labelling machine there is a risk that adhesive from the edges of the labels on the web will be gradually deposited on said components of the labelling machine thereby creating the risk of the web becoming adhered to the said components and causing failure of the labelling machine.

The motor may take any convenient form. However, in preferred embodiments of the invention the motor is a position-controlled motor. A position-controlled motor is a motor controlled by a demanded output rotary position. That is, the output position may be varied on demand, or the output rotational velocity may be varied by control of the speed at which the demanded output rotary position changes.

An example of a position-controlled motor is a stepper motor. A stepper motor is an open loop position-controlled motor, that is, it is supplied with an input signal relating to a demanded rotational position or rotational velocity, the stepper motor being driven to achieve the demanded position or velocity. A stepper motor may also be provided with an encoder providing a feedback signal indicative of the actual output position or velocity. The feedback signal may be used to generate an error signal by comparison with the demanded output rotary position, the error signal being used to drive the motor to minimise the error. A stepper motor provided with an encoder in this manner comprises a closed loop form of position-controlled motor.

An alternative form of closed loop position-controlled motor comprises a DC motor provided with an encoder. The output from the encoder provides a feedback signal from which an error signal can be generated when the feedback signal is compared to a demanded output rotary position, the error signal being used to drive the motor to minimise the error.

The linear displacement sensor may comprise an optical sensor. The optical sensor may comprise a charge coupled device (CCD).

The linear displacement sensor may also be operable to sense displacement of the web in a direction other than the direction of the web path. That is "tracking" of the web may be monitored by monitoring displacement of the web in, for example, a direction substantially perpendicular to the direction of the web path. The direction substantially perpendicular to the direction of the web path may be in the plane of the web. For example, where guide rollers are provided along the web path, the direction substantially perpendicular to the direction of the web path may be parallel to the axes of the guide rollers.

The labelling machine may further comprise a printer. The printer can take any suitable form and may be a drop on demand ink jet printer of the type described in our UK Patent No. GB2,370,532, the contents of which are incorporated herein by reference. Alternatively, the printer may be a thermal transfer printer in which ink is carried on a ribbon moved between a ribbon supply spool and a ribbon take-up spool. The ink on the ribbon is heated to cause ink to be removed from the ribbon and deposited on the labels. An example of a thermal transfer printer is described in our UK Patent No. GB 2,369,602, the contents of which are incorporated herein by reference. A further alternative is for the printer to be a laser marker used in conjunction with labels coated with a material which is sensitive to laser light and which changes colour when exposed to laser light, so that a matrix of laser "dots", or a path scribed by a moving laser beam can create a visible two dimensional image.

The printer may be moveable between a first position, in which it is operable to print onto labels supported on the web travelling along the web path, and a second position in which it is removed from the web path. In the second position the printer may be operable to print on a package or container conveyed along a path adjacent the labelling machine.

The labelling machine may comprise a second sensor operable to sense an edge of a label adhered to the web. The second sensor may be an optical sensor and may comprise an optical source and an optical detector. The optical source and optical detector may be suitably positioned to be operable in a transmissive mode.

The labelling machine may comprise a controller arranged to determine a linear distance through which a web should be moved, determine a number of steps through which the stepper motor should be driven to effect movement of the web through the linear distance, and control the stepper motor to turn the determined number of steps. It will be appreciated that where the motor is not a stepper motor, the controller will be appropriately configured to carry out suitable equivalent processing.

The controller may be configured to receive a signal from the second sensor indicating that an edge of a label has been sensed; based upon the received signal, to determine a second linear distance through which the web should be moved so as to position an edge of a label adhered to the web in a predetermined position; and to control the motor to move the web through the second linear distance. In this way, the controller may be arranged to ensure that a label edge is correctly positioned relative to a label separating device such as a peel beak.

The means for removing labels from the web as the web is transferred from the supply spool to the take up spool may comprise a label transfer device for transferring a label from a label carrying web travelling in a first direction along a first path to a substrate disposed adjacent to the labelling machine. The label transfer device may take the form of a peel beak, sometimes referred to as a label separating beak. That is, the substrate is a surface onto which labels are affixed, for example the surface of a product being conveyed past the labelling machine. The label transfer device may comprise a separator surface over which the label-carrying web passes in use, the separator surface comprising a first portion inclined relative to the web path and a second arcuate portion for redirecting the web to a second direction where it travels, in use, along a second path. A label is separated from the web and transferred to the substrate as it passes over the separator surface.

Using a label transfer device of this type is advantageous as it tends to cause a label to be removed in such a way that its adherence to a passing product is encouraged.

The label transfer device may have a first surface defining at least part of the first path. The first portion of the separator surface may be inclined to said first surface. The label transfer device may have a second surface defining at least part of the second path. The separator surface may be intermediate of the first and second surfaces. The first and second surfaces may be substantially parallel. The first portion may be inclined relative to the web path at an angle of between 10° and 20°, and preferably at an angle of about 15°. The label transfer device may be an elongate member having an end defining a separator surface.

The take-up spool support may comprise a spool support having a substantially cylindrical wall having an outer surface defining an opening for receipt of material to be wound onto the take-up spool support, the opening extending along at least part of its the length; and an attachment member located radially inwards of the outer surface of the cylindrical wall and being moveable between a first position in which the material is secured to the support and a second position in which the material can be removed from the take-up spool support.

Thus, a convenient mechanism for attaching a web to the takeup spool support is provided.

The material may be trapped between the attachment member and the spool support when the attachment member is in the first position. In the first position, the attachment member may substantially close the opening. The attachment member may be moveable radially between said first and second positions. The take-up spool support may further comprise an actuator member arranged to move the attachment member between said first and second positions. Movement of the actuator member in a first direction may cause movement of the attachment member in a second non-parallel direction. The first and second directions may be substantially perpendicular. The actuator member may be moveable in a direction substantially parallel to that of the longitudinal axis of take-up spool support.

According to a second aspect of the present invention, there is provided, a drive mechanism for use in a labelling machine, the mechanism being arranged to transfer a web from a first spool to a second spool along and a web path between the first and second spools, the drive mechanism comprising a motor operable to cause the web to travel along the web path and to be wound onto the second spool, the drive mechanism comprising a displacement sensor operable to sense displacement of the web in a direction other than the direction of the web path, for example in a direction non-parallel to the direction of the web path.

Thus, the second aspect of the invention allows "tracking" of the web up or down relative to guide rollers provided along the web path to be monitored using the displacement sensor. The direction in which "tracking" is monitored may be in the plane of the web.

The direction non-parallel to the web path may be substantially perpendicular to the web path. The displacement sensor may be an optical sensor and may comprise a charge coupled device (CCD).

The displacement sensor may also be operable to determine the rate of linear displacement of the web travelling along the web path.

The labelling machine may further comprise guide rollers. The controller may be adapted to control the guide rollers is response to sensed displacement of the web in the direction non-parallel relative to the web path. Such control may be arranged to correct for undesired movement of the web, for example by tilting the axes of the guide rollers using an actuator such as a linear actuator.

According to a third aspect of the present invention, there is provided a labelling machine configured to remove labels from a label carrying web travelling along a web path and to apply removed labels to respective objects, the labelling machine comprising a printer moveable between a first position in which it is operable to print onto labels on a web travelling along the web path, and a second position in which it is displaced from the web path.

The third aspect of the present invention therefore provides a versatile labelling machine which can be used with pre-printed labels onto which nothing is to be printed, but also with labels onto which information is to be printed before application of the labels to a product or container. Additionally, the labelling machine of the third aspect of the invention may be used such that labels are applied to a product or container and subsequently printed upon using the printer in the second position. In the second position the printer may be used to print directly onto a product or container. Thus, the third aspect of the present invention provides a single labelling machine which can carry out a plurality of functions which would normally have required a plurality of different labelling and printing machines.

According to a fourth aspect of the present invention, there is provided a labelling machine comprising

- a label transfer device for transferring a label from a label carrying web travelling in a first direction along a first path to a substrate disposed adjacent to the labelling machine, the label transfer device comprising:
- a separator surface over which the label-carrying web passes in use, the separator surface comprising a first portion inclined relative to the web path and a second arcuate portion for redirecting the web to a second direction where it travels, in use, along a second path;
- whereby a label is separated from the web and transferred to the substrate as it passes over the separator surface.

The label transfer device may have a first surface defining at least part of the first path. The first portion of the separator surface may be inclined to the first surface. The label transfer device may have a second surface defining at least part of the second path. The separator surface may be intermediate of the first and second surfaces. The first and second surfaces may be substantially parallel. The first portion may be inclined relative to the web path at an angle of between 10° and 20°, and preferably at an angle of about 15°.

According to a fifth aspect of the present invention, there is provided a take up spool for receiving a spool of material, the take up spool comprising:

a spool support having a substantially cylindrical wall having an outer surface defining an opening for receipt of material to be wound onto the spool support, the opening extending along at least part of its the length; and an attachment member located radially inwards of the outer surface of the cylindrical wall and being moveable between a first position and in which the material is secured to the support and a second position in which the material can be removed from the take-up spool support.

The material may be trapped between the attachment member and the spool support when the attachment member is in the first position. In the first position, the attachment member may substantially close the opening. The attachment member may be moveable radially between the first and second positions. The take-up spool support may further comprise an actuator member arranged to move the attachment member between said first and second positions. Movement of the actuator member in a first direction may cause movement of the attachment member in a second non-parallel direction. The first and second directions may be substantially perpendicular. The actuator member may be moveable in a direction substantially parallel to that of the longitudinal axis of take-up spool support.

Embodiments of the present invention will now be described, by way of example, with reference to the accompanying drawings, in which.

Figure 1:
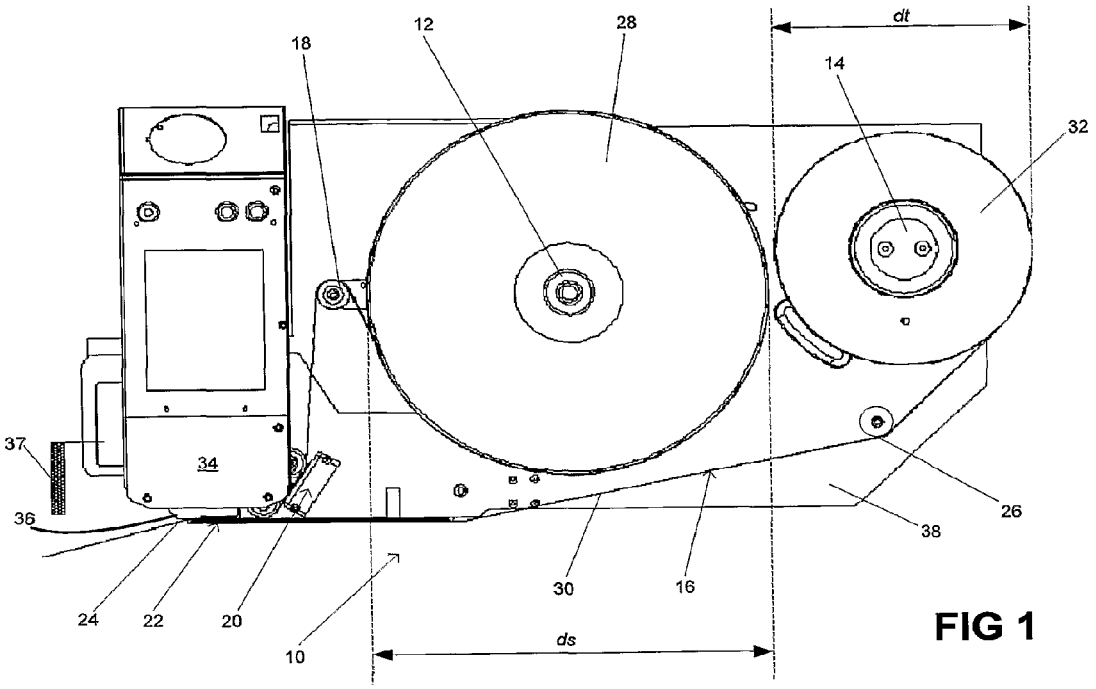
FIG. 1 is a schematic drawing in plan view of a labelling machine according to an embodiment of the present invention showing a printer in a first position.

Referring to FIG. 1, a labelling machine 10 has a supply spool support 12 and a take-up spool support 14. As described in further detail below, a web is transported along a web path 16 extending between the supply spool support 12 and the take-up spool support 14.

Positioned along the web path 16 is a dancer arm roller 18, a sensor unit 20, a printing substrate support 22, a label separating beak 24, and an idler roller 26.

In use a supply spool 28, carrying a supply of labels temporarily adhered to a web 30, is mounted on the supply spool support 12. The web 30 extends along a web path 16 from the supply spool 28, around the dancer arm roller 18, through the sensor unit 20, along the printing substrate support 22, around the separating beak 24, over the idler roller 26 and is wound onto a take-up spool support 14 to form a take-up spool 32.

The labelling machine 10 also has an ink jet printer 34 having a print head 36. The printer 34 is moveable between a first position, as shown in FIG. 1, in which the print head 36 overlies the printing substrate support 22, and a second position in which the printer is displaced away from the web path 16. Although not operable to print onto a label on the web when in the second position, the printer 34 can be used to print directly onto a substrate (for example a product) adjacent the labelling machine 10. For example, when the printer is in the second position, the labelling machine 10 can be used to apply labels to a box passing the labelling machine or configured not to apply labels at all, and the printer 34 can be used to print onto the box, either onto a label applied to the box or alternatively directly onto the surface of the box. The printer 34 is shown in the second position in FIG. 2, in which it can be seen that the printing head 36 is displaced from the printing substrate support 22.

The labelling machine 10 is also provided with a wipe down brush 37 arranged to press a label against the item to which it is to be attached. In alternative embodiments of the invention, the brush may be replaced with a roller arranged to carry out a similar purpose. Alternatively, an air blast may be provided to help in securing a label to the item to which it is affixed.

The above-mentioned features are all mounted on a platform 38.

Figure 3:
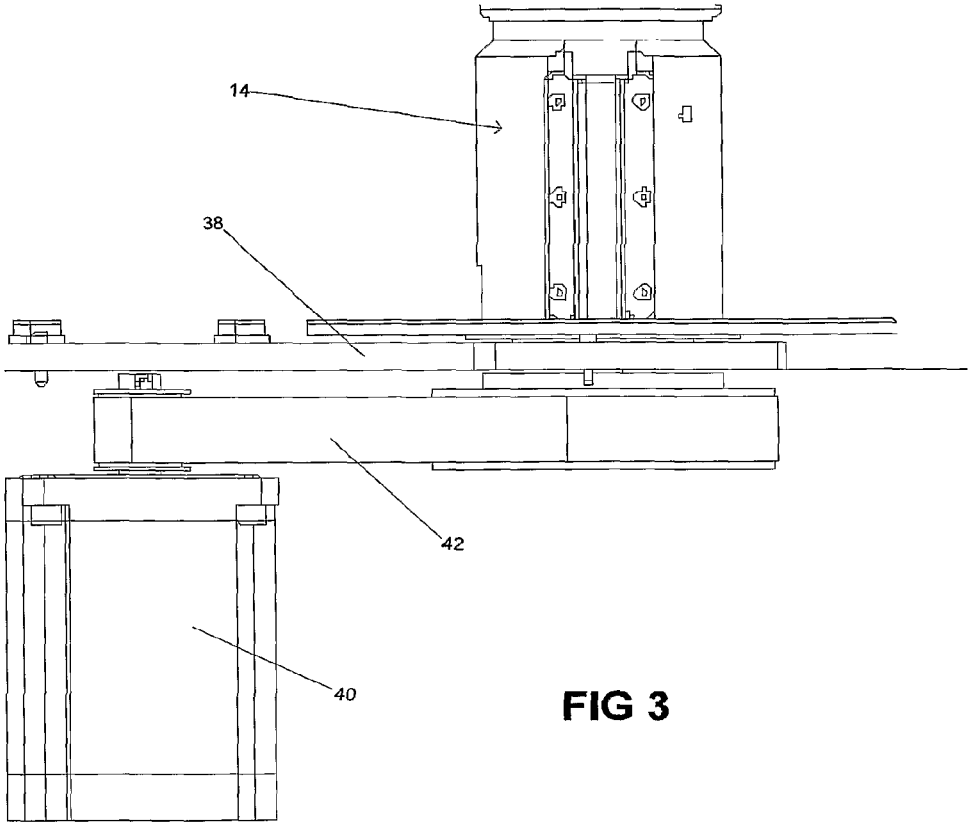
FIG. 3 is a schematic drawing in elevation of a stepper motor and take-up spool support of the labelling machine of FIGS. 1 and 2.

Referring to FIG. 3, the labelling machine has a stepper motor 40 disposed below the platform 38. The stepper motor 40 is mechanically connected to the take-up spool support 14 by a drive belt 42 through which it drives the take-up spool support 14. Such a connection arrangement is preferred as it provides reliability over a long lifespan, and has low backlash. It will however be appreciated that the stepper motor 40 may drive the take-up spool support 14 in any convenient way.

Figure 4:
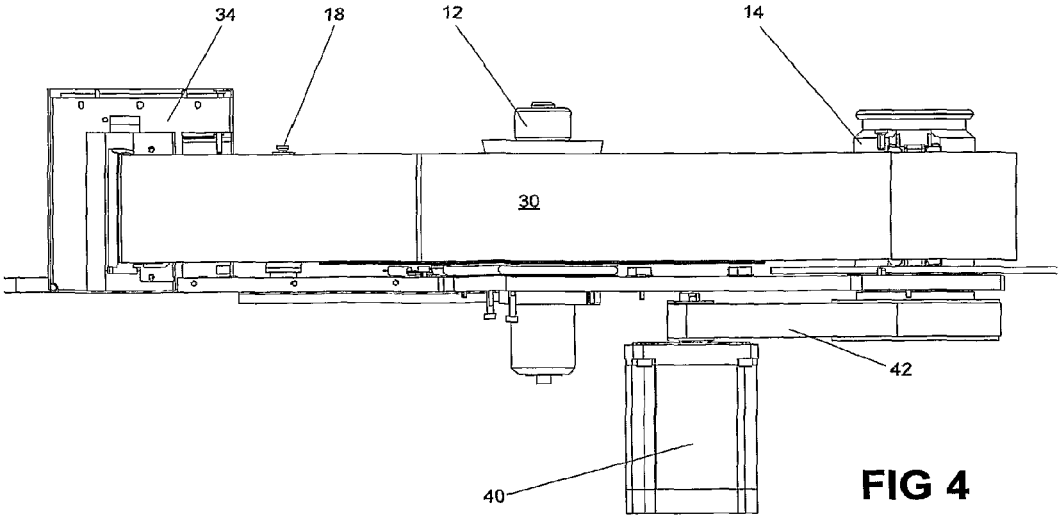
FIG. 4 is a schematic drawing in elevation of the labelling machine of FIGS. 1 and 2.
Figure 4A:
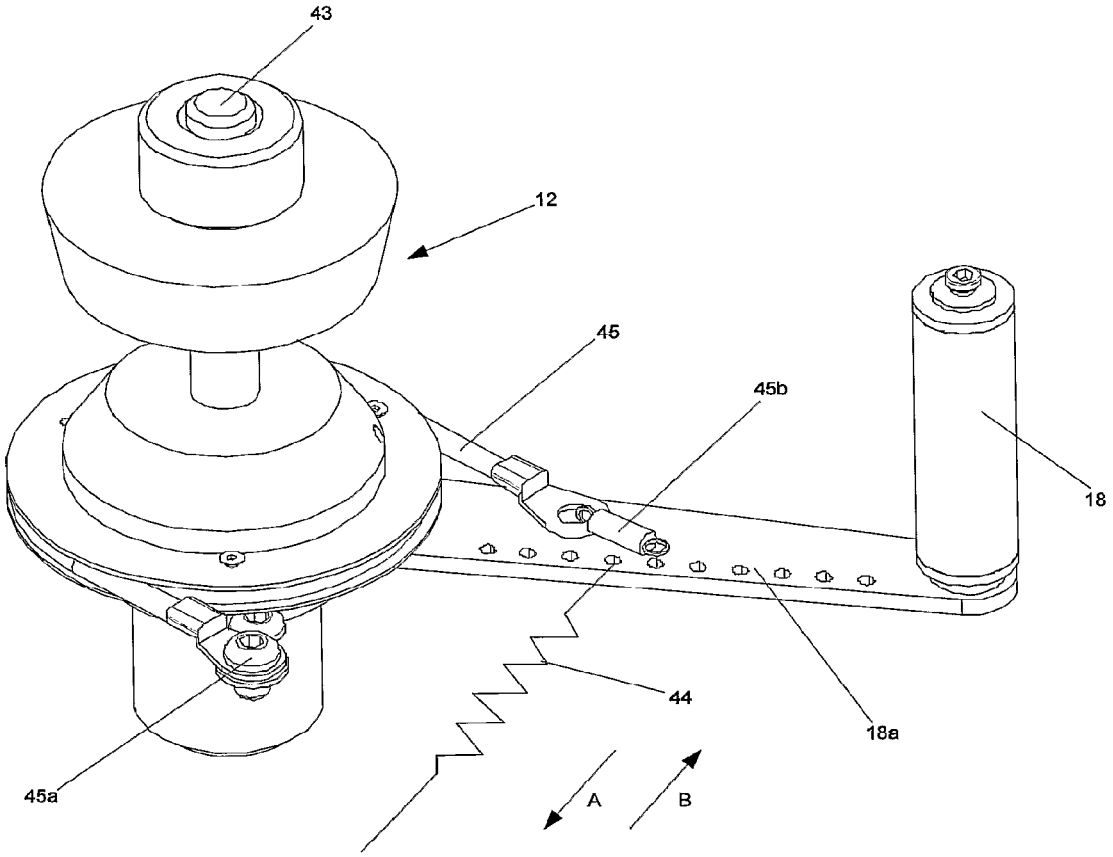
FIG. 4A is a drawing showing a perspective view of a supply spool support and dancer arm of FIG. 4 in further detail.

Referring also to FIG. 4, in use the take-up spool support 14 is driven by the stepper motor 40 such that the web 30 is wound on to the take-up spool support 14 from the supply spool 28, mounted on the supply spool support 12. As best seen in FIG. 4A, the dancer arm roller 18 is mounted on a dancer arm 18*a*. In the illustrated arrangement, the dancer arm 18*a* and the supply spool support 12 rotate about a common axis 43. It will however be appreciated that the dancer arm 18*a* and the supply spool support 12 need not rotate about a common axis, but may instead rotate about respective axes. The dancer arm 18 is biased in a direction indicated by an arrow A by the action of a spring 44. A brake cord 45 has a first end fixed to a fixed point 45*a* on the platform 38 (not shown in FIG. 4A), extends around the supply spool support 12 and has a second end fixed to the dancer arm 18 by means of a spring 45*b*.

It can be seen that as the dancer arm 18*a* moves in the direction of the arrow A the brake cord 45 acts to brake the supply spool support 12, thereby resisting movement of the supply spool support 18. Movement of the dancer arm 18*a* in the direction of an arrow B acts to release the brake cord from the supply spool support 12 thereby easing movement of the supply spool support 12. In use, as tension in the web increases, the dancer arm 18*a* is urged in the direction of the arrow B by the web, against the force of the spring 44. This causes the brake applied to the supply spool support 12 by the brake cord 45 to be released, easing rotation of the supply spool support 12 so as to reduce tension in the web. If however tension in the web decreases, the dancer arm 18*a* moves in the direction of the arrow A under the force of the spring 44, causing the brake cord 45 to apply a brake to rotation of the supply spool support 12, and to consequently increase tension in the web. Thus, it can be appreciated that the dancer arm 18*a* acts to regulate and control tension in the web.

Figure 5:
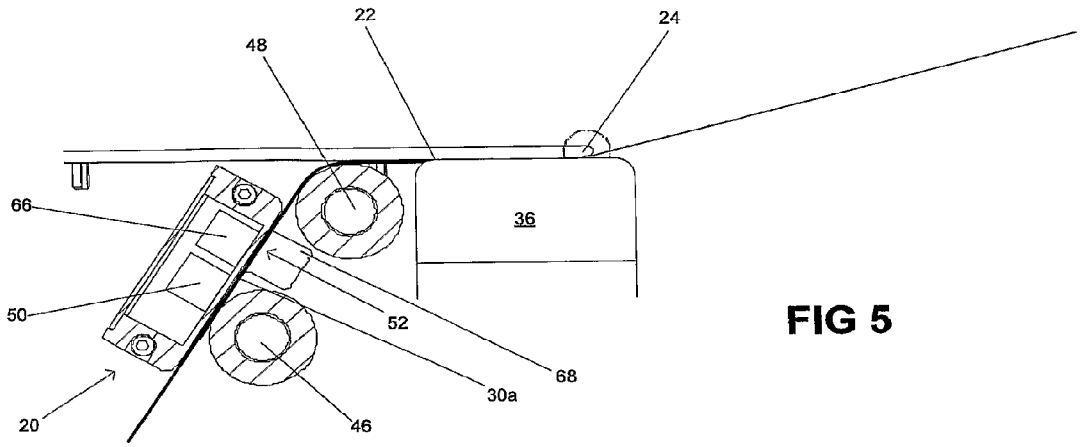
FIG. 5 is a schematic drawing in plan view of a sensor unit, print head and label separating beak of the labelling machine of FIGS. 1 and 2.

Referring to FIG. 5, the sensor unit 20 comprises a linear displacement sensor 50 and a label position sensor 52. The sensor unit 20 is positioned in advance of the print head 36 on the web path 16. First and second sensor idler rollers, 46 and 48 are spaced apart from each other and assist in maintaining the portion of web 30*a* travelling past the sensor unit 20 in a consistent position, thereby facilitating accurate measurements of the web by the sensor unit 20.

It will be appreciated that the linear displacement sensor 50 and the label position sensor 52 need not be housed in a single unit, but could instead be housed in separate units which are appropriately positioned relative to the web path.

The linear displacement sensor 50 is operable to measure the displacement of the web 30 prior to the print head 36 and the label separating beak 24. The linear displacement sensor 50 can take any suitable form. For example, it may take the form of an optical sensor. Such an optical sensor may take the form of a charge coupled device (CCD), which captures two images of the web, or labels attached thereto, as they move from the supply spool 28 to the take-up spool 32. The two images are captured a known time apart. By comparing the captured images, and processing data generated by the comparison together with data indicating the time between capture of the two images, the magnitude and direction of the displacement of the web as well as the rate of displacement of the web can be determined as described below. There are a wide range of commercially available CCDs. Suitable CCDs are commonly used within an optical computer mouse, and may be commonly referred to as optical mouse sensors.

At the time of writing, an example of a suitable commercially available optical mouse sensor that may be used is the ADNS-3060, which is manufactured by Agilent Technologies. The ADNS-3060 is an optical sensor that is often used to detect high speed motion, for instance speeds of up to approximately 1 $ms^{-1}$, and accelerations of up to approximately 150 $ms^{-2}$.

The sensor operates by recording a series of images of the surface that passes over it, typically 6400 images per second. The resolution of each image may be up to 800 counts per inch (cpi). In the present invention the optical mouse sensor has sufficient resolution to detect surface markings on the web and labels attached thereto. The optical mouse sensor measures changes in position by optically acquiring sequential surface images at a known frame rate and determining the direction and magnitude of the movement between consecutive frames by identifying the common part of the web and/or labels in the captured images. By recording a plurality of frames over a known time period, the displacement of the web 30 both in an x direction (shown in FIG. 6B) and a y direction (also shown in FIG. 6B) can be monitored. The speed and acceleration of the web 30 can also be calculated from such displacement information.

The optical mouse sensor drives a light source in the form of an LED together with a CCD for capturing images at a predetermined rate. An internal microprocessor is adapted to calculate the relative motion between frames in both first and second orthogonal directions (i.e. the x direction and the y direction) and provide the calculated relative motion to a controller.

Figure 6A:
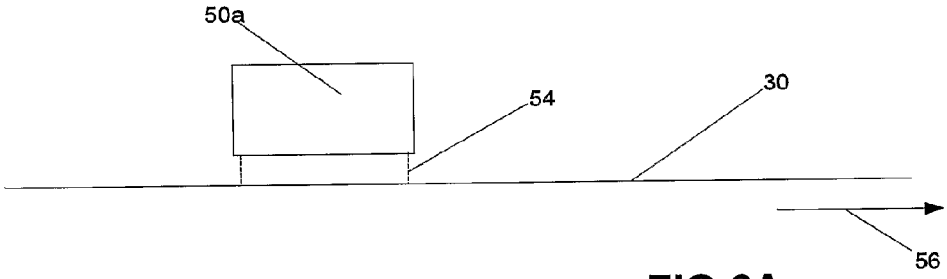
FIG. 6A is a schematic drawing in plan view showing an arrangement in which a linear displacement sensor is arranged to determine displacement of a web.

FIG. 6A shows a schematic plan view of an optical mouse sensor 50*a* being an example of the linear displacement sensor 50 referred to above and the web 30. The field of view of the optical mouse sensor 50*a* is indicated by dashed lines 54. For the purpose of explaining the operation of the optical mouse sensor 50*a* the web 30 is considered only to be moving in a single direction, indicated by an arrow 56. However, it will be appreciated that in principle the displacement of the web may be measured in any direction.

Figure 6B:
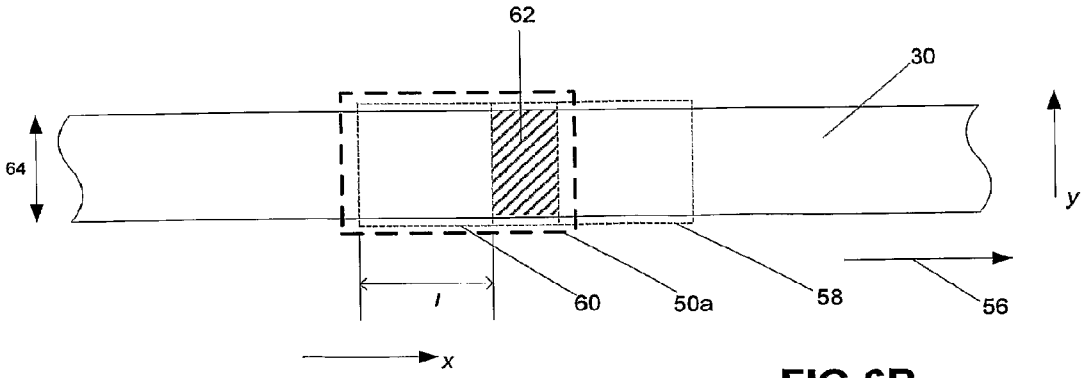
FIG. 6B is a schematic drawing in elevation showing how the linear displacement sensor of FIG. 6A, determines the displacement of the web.

FIG. 6B is a schematic elevation of the same optical mouse sensor arrangement of FIG. 6A. The optical mouse sensor 50*a* is shown in dashed outline so as not to obscure the representation of the field of view of the optical mouse sensor 50*a*. FIG. 6B further shows a first image 58 captured by the optical mouse sensor 50*a*. The web 30 has moved to the right (in the direction of arrow 56) since the first image 58 was captured such that the web 30 is now positioned relative to the optical mouse sensor 50*a* as shown and a second image 60 is captured, corresponding to the current field of view of the optical mouse sensor 50*a*.

It can be seen that the first image 58 and the second image 60 include a common part of the web indicated by the hatched area 62. By comparing patterns in the surface of the web 30 captured in the two images 58 and 60, the area of overlap 62 between the two images can be detected. A length in the direction of the arrow 56 associated with the area of overlap 62 can be determined, and by subtracting this length from a known width associated with the field of view (as shown in FIG. 6A between dotted lines 54), displacement of the web 30 (denoted I in FIG. 6B) in the x direction can be determined. Furthermore, the position of the area of overlap 62, in each of the images 58 and 60 indicates the direction of displacement of the web 30 (i.e. the direction denoted by arrow 56 in the example of FIG. 6B). As long as consecutive images are recorded sufficiently frequently that they contain an area of overlap even when the web 30 is travelling at a maximum velocity, then relative displacement I of the web 30 between consecutive images will be measurable. The maximum frequency at which images can be recorded is determined by operational characteristics of the optical mouse sensor 50*a*.

In the same manner as described above, the optical mouse sensor 50*a* can also determine relative displacement of the web 30 in a y direction (shown in FIG. 6B). Therefore, correct vertical registration of the web 30 (i.e. registration in the y direction shown in FIG. 6B) can also be maintained by controlled guide rollers, operable to guide the web in a direction as shown by arrow 64. Such controlled guide rollers may be moved by a suitable actuator, such as a linear actuator. In the event of unacceptable movement of the web in the y direction, a fault may be signalled.

Figure 7:
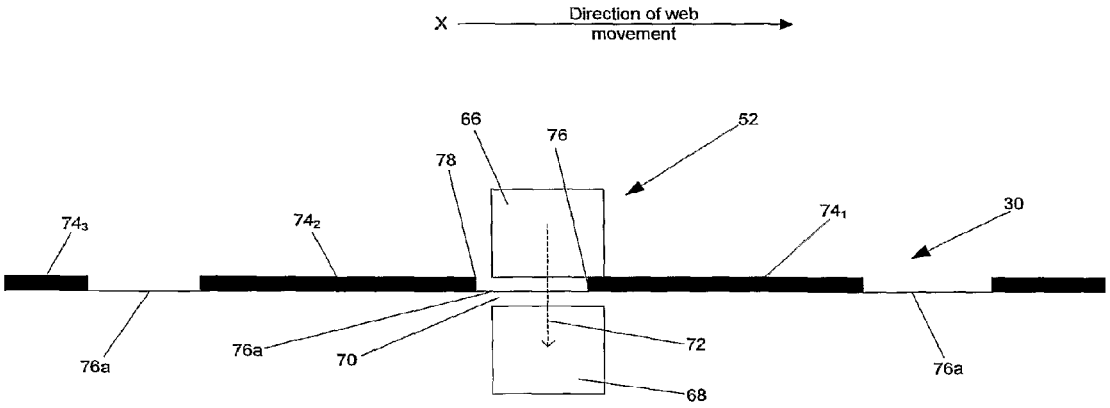
FIG. 7 is a schematic drawing in plan view showing how a label position sensor, determines the position of a label.

Referring to FIG. 7, operation of the label position sensor 52 is described. The label position sensor 52 has a light source 66, such as an LED, and an optical detector 68. The light source 66 and optical detector 68 are spaced apart such as to provide a gap 70 through which the web 30 passes. The light source 66 and optical detector 68 are arranged such that the detector 68 can detect light 72 directly transmitted from the light source 66. The web 30 has a plurality of labels $\mathbf{74}_1$ to $\mathbf{74}_n$ temporarily adhered thereto and spaced apart along the length thereof, such that a region of exposed web 76*a* lies between each adjacent label $\mathbf{74}_1$ to $\mathbf{74}_n$. The web is formed from a relatively light transmissive material, whereas the labels are formed from a relatively opaque material. The label position sensor 52 is disposed at a predetermined distance from the label separating beak 24 (as shown in FIG. 5), which enables the controller to stop the web in a desired position relative to the label separating beak 24 when a label has been dispensed from the separating beak 24 (FIG. 1), as is described in further detail below.

Figure 11:
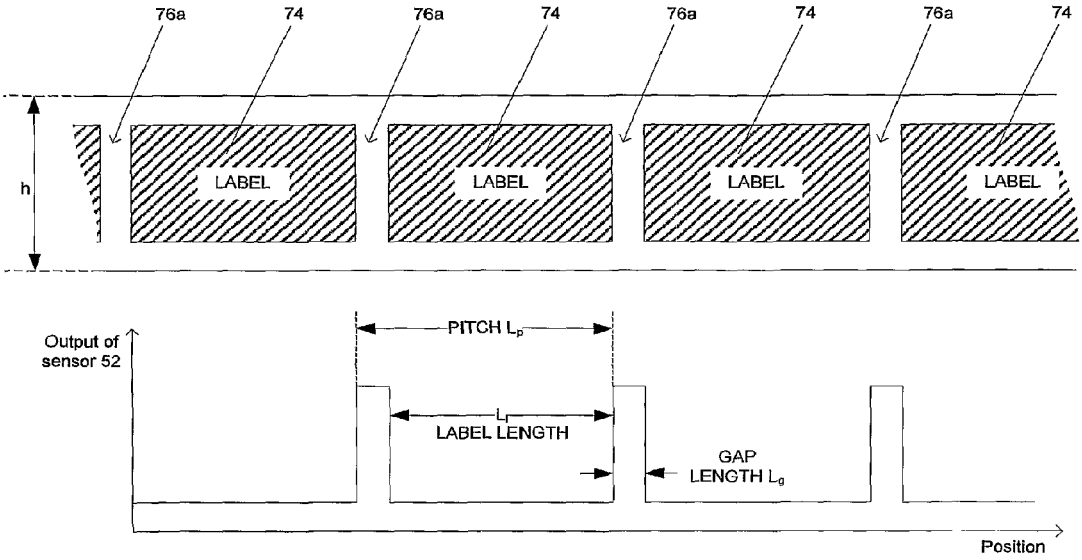
FIG. 11 is an illustration showing how the output of a label position sensor varies as a series of labels passes the label position sensor.

The web 30 is accelerated and decelerated to achieve the required speed of web movement. In use, the web 30 travels along a web path between the supply spool 28 and the take-up spool 32 and through the gap 70 in a direction indicated by an arrow X. In the gap 70 the web 30 travels between the light source 66 and the optical detector 68. As each label $\mathbf{74}_1$ to $\mathbf{74}_n$ passes between the light source 66 and optical detector 68, the light 72 emitted from the light source 66 is occluded from the optical detector 68 and the optical detector provides a negative signal (i.e. a signal indicating light occluded) to the controller indicative thereof. As a trailing edge 76 of label $\mathbf{74}_1$ passes between the light source 6 and the optical detector 68 the emitted light 72 is able to pass through the web 30 and is detected by the optical detector 68. Upon detecting the light 72, the optical detector 68 provides a positive output signal indicative of the passing of the trailing edge 76 of label $\mathbf{74}_1$. The positive output signal is retained for the duration of the passing of the region of exposed web 76*a*, until the leading edge 78 of the following label $\mathbf{74}_2$ occludes the light 72 from the optical detector 68, whereupon the positive output signal is no longer generated by the optical detector 68. The optical detector therefore generates a pulse signal for the duration of the passing of the region of exposed web 76*a*, that is, in this example between the trailing edge 76 of the leading label $\mathbf{74}_1$ and the leading edge 78 of the following label $\mathbf{74}_2$. The pulse signal (as shown in FIG. 11) is transmitted to a controller which uses the pulse signal and knowledge of the predetermined linear distance between the label position sensor 52 and the label separating beak 24, to calculate a number of steps through which the stepper motor driving the web should be driven so as to ensure that it is stopped in a correct position relative to a label separating beak 24 (FIG. 1), thereby allowing correct dispensing of labels from the label carrying web as described in further detail below.

The stepper motor 40 is selected so as to have sufficient torque to accelerate, decelerate and move the web 30 as desired, for a range of take-up spool sizes encountered in normal operation.

In general terms, the torque which the stepper motor 40 is required to provide is given by equation (1):

$$T = \frac{2GA_{target}}{d_t}\left(I_m + \frac{I_{spool} + I_{ss}}{G^2}\right) + t\frac{d_t}{2G} \tag{1}$$

Where T is the required torque (in μNmm);

$I_m$ is the moment of inertia of the motor rotor, which can be obtained from a manufacturer's data sheet for the selected motor (in $gmm^2$);

$I_{spool}$ is the moment of inertia of the take-up spool 32 (in $gmm^2$);

$I_{ss}$ is the moment of inertia of the take-up spool support 14 (in $gmm^2$);

$A_{target}$ is the target linear acceleration of the web (in $mms^{-2}$);

$d_t$ is the diameter of the take-up spool 32 (in mm);

t is the tension in the web 30 between the label separating beak 24 and the take up spool 32 (in μN); and G is a gear ratio, given by:

$$G = \frac{\text{Number of teeth on pulley of take-up spool support 14}}{\text{Number of teeth on pulley of stepper motor 40}}$$

Equation (1) is based upon the general principle that the torque of the stepper motor 40 must overcome the restive force provided by tension in the web 30, and also overcome the inertia of the stepper motor 40, the take-up spool support 14 and the take-up spool 32. That is, equation (1) has the general form:

$$\text{Torque}=\text{Torque required to overcome inertia}+\text{Torque required to overcome tension} \tag{2}$$

The torque required to overcome tension (i.e. the second component in equation (2)) is given by the tension (t) multiplied by the radius of the take-up spool 32 at which the tension acts (i.e $$\frac{d_t}{2}),$$

divided by the gear ratio G defined above (given that the stepper motor 40 turns the take-up spool 32 through the gear ratio G.)

The torque required to overcome the inertia loads of the components identified above (i.e. the first component of equation (2) is given by equation (3):

$$T_I = I\alpha \tag{3}$$

where $T_I$ is the torque required to overcome the inertia;

I is the total moment of inertia; and

α is angular acceleration (in radians $s^{-2}$).

In general terms the angular acceleration a is given by:

$$\alpha = \frac{\text{linear acceleration}}{\text{radius}} \tag{4}$$

It is further known that the effective moment of inertia of a load driven through a particular gear ratio G is equal to its inertia divided by the square of the gear ratio G.

Thus, equation (3) can be written as:

$$T_l = \left(I_m + \frac{I_{spool} + I_{ss}}{G^2}\right) G \frac{A_{target}}{r_t} \tag{5}$$

where $r_t$ is the radius of the take-up spool 32 (in mm).

Given that:

$$r_t = \frac{d_t}{2} \tag{6}$$

it can be seen that:

$$T_l = \left(I_m + \frac{I_{spool} + I_{ss}}{G^2}\right) \frac{A_{target} G}{d_t/2} \tag{7}$$

$$T_l = \frac{2GA_{target}}{d_t}\left(I_m + \frac{I_{spool} + I_{ss}}{G^2}\right) \tag{8}$$

From the preceding equations it can be seen that equation (1) above correctly indicates the required torque capability of the stepper motor 40. It is to be noted that equation (1) does not include any component to take into account inertia of the supply spool 28. This is because the dancer arm 18*a* acts to regulate tension in the web so as to be substantially constant, such that drive of the take-up spool 32 is not affected by the inertia of the supply spool 28 to any great extent. While there will be some variations in tension in practice, a workable arrangement can be achieved without taking the inertia of the supply spool into account.

It should also be appreciated that although the value of tension t used in the equations set out above represents the tension between the label separating beak 24 and the take up spool 32, tension in other parts of the web 30 is overcome by the stepper motor 40. A workable arrangement can, however, be achieved without considering other tensions in the web 30 when determining the torque requirements of the stepper motor 40.

To the extent that tension in the web 30 between the label separating beak 24 and the take up spool 32 varies with the linear speed of the web 30 then the worst case (i.e. highest) tension should be used to provide a value for t in the above equations.

It is known that the torque which a stepper motor is able to provide varies with the step rate of the stepper motor. As such, it is necessary to ensure that the stepper motor 40 is able to provide the required torque at the maximum required step rate. The maximum required step rate will vary in dependence upon the diameter of the take-up spool 32. If maximum linear feed speed of the web 30 is $V_{max}$ (expressed in $mms^{-1}$) the maximum step rate $N_{max}$ is given by equation (9):

$$N_{max} = GN_{revolution} \frac{V_{max}}{\pi d_t} \tag{9}$$

Where $N_{revolution}$ is the number of steps through which the stepper motor turns in a single revolution. Different stepper motors are designed with different numbers of steps per single revolution. A typical stepper motor is designed to have 200 steps per revolution. Such a stepper motor would be specified to have a so-called "Step Angle" (i.e. the angle through which the motor turns in a single step) of 1.8° Furthermore, the controller may control the stepper motor to move in increments of steps, or in smaller increments of, for example, quarter steps (i.e. 0.45° step angle), or sixteenth steps (i.e. 0.1125° step angle). These smaller increments are often referred to as micro-steps and a controller which controls a stepper motor in this way is often referred to as "micro-stepping" the motor. In this description, references to "steps" can equally apply to steps or micro-steps, and where micro steps are used the parameter indicating the number of steps in a single revolution ($N_{revolution}$) will be taken to be the number of microsteps per revolution.

Using equation (9) the step rate at which the stepper motor will be driven when the take-up spool is at each of its maximum and minimum diameters can be calculated from equations (10) and (11):

$$N_{max1} = GN_{revolution} \frac{V_{max}}{\pi d_{tmin}} \tag{10}$$

$$N_{max2} = GN_{revolution} \frac{V_{max}}{\pi d_{tmax}} \tag{11}$$

Where $d_{tmin}$ and $d_{tmax}$ are respectively, the minimum and maximum operational diameters of the take-up spool 32.

Using equation (1) above it is also possible to determine the torque which needs to be provided by the stepper motor 40 when the take-up spool 32 is at its maximum diameter ($d_{tmax}$) and its minimum diameter ($d_{tmin}$)

$$T_1 \geq F_s\left[\frac{2GA_{target}}{d_{tmin}}\left(I_m + \frac{I_{ss}}{G^2}\right) + \frac{td_{tmin}}{2G}\right] \tag{12}$$

$$T_1 \geq F_s\left[\frac{2GA_{target}}{d_{tmax}}\left(I_m + \frac{I_{spool} + I_{ss}}{G^2}\right) + \frac{td_{tmax}}{2G}\right] \tag{13}$$

Where $T_1$ is the torque requirement at the minimum diameter of the take-up spool 32, and $T_2$ is the torque requirement at the maximum diameter of the take-up spool 32.

It can be noted that there is no term relating to the moment of inertia of the take-up spool 32 ($I_{spool}$) in equation (12). This is because the spool has a minimum diameter (i.e. is "empty") and therefore no inertia which need to be taken into account.

It can be seen that each of equations (12) and (13) are based upon equation (1) but additionally include a factor $F_s$ which indicates a factor of safety specified so as to require the stepper motor 40 to have a torque capability greater than the calculated maximum, thereby providing robustness in the design. It has been found that setting $F_s$ to a value of 2 gives good results.

The moment of inertia $I_{spool}$ of the take-up spool 32 is given by the standard equation for the moment of inertia of a hollow cylinder:

$$I_{spool} = \text{mass}\left(\frac{d_{tmax}^2}{8} + \frac{d_{tmin}^2}{8}\right) = \rho \times \text{vol} \times \left(\frac{d_{tmax}^2}{8} + \frac{d_{tmin}^2}{8}\right) \tag{14}$$

where ρ is the density of the web (in $gmm^{-3}$); and vol is the volume of the web.

The volume of the take-up spool 32 is given by equation (15):

$$\text{vol} = h\pi\left[\left(\frac{d_{tmax}}{2}\right)^2 - \left(\frac{d_{tmin}}{2}\right)^2\right] \tag{15}$$

where h is the height of the web as indicated in FIG. 11.

It follows (substituting equation (15) into equation (14)) that the inertia of the take-up spool is given by:

$$I_{spool} = \left[\rho\pi h\left[\left(\frac{d_{tmax}}{2}\right)^2 - \left(\frac{d_{tmin}}{2}\right)^2\right]\right]\left[\frac{d_{tmax}^2}{8} + \frac{d_{tmin}^2}{8}\right] = \rho\pi h\left(\frac{d_{tmax}^4 - d_{tmin}^4}{32}\right) \tag{16}$$

Substituting equation (16) into equation (13) gives:

$$T_2 \geq F_s\left[\frac{2GA_{target}}{d_{tmax}}\left(I_m + \frac{\pi h\rho\left(\frac{d_{tmax}^4 - d_{tmin}^4}{32}\right) + I_{ss}}{G^2}\right) + \frac{td_{tmax}}{2G}\right] \tag{17}$$

The torque requirement given by equation (12) is required when the diameter of the take-up spool 32 is a minimum, that is when the maximum step rate of the stepper motor 40 is given by equation (10). The torque requirement of equation (17) is required when the diameter of the take-up spool 32 is a maximum, that is when the maximum step rate of the stepper 40 is given by equation (11).

It will be appreciated that equations (12) and (17) together with equations (10) and (11) allow an appropriate motor to be chosen, by making reference to motor manufacturers' data sheets providing details of the relationship between step rates and torques provided. It will be appreciated that the gear ratio between the motor and the take-up spool support may also be modified to ensure compliance with the requirements of equations (12) and (17).

In one preferred embodiment of the invention the motor is an MST 342CO2 manufactured by JVL UK Limited. This preferred embodiment of the invention uses a gear ratio (as defined by above) of 4.

Having selected a motor on the basis of the preceding description, the maximum linear acceleration and deceleration, for a given label height, can be determined by rearranging the equations set out above as is now described, and using the actual values of torque provided by the chosen motor as determined using information provided in, for example, a manufacturer's data sheet. Such torque is usually referred as "pull-out" or "get away" torque.

If the left and right hand sides of equation (12) are equal, an expression for the linear deceleration (the parameter $A_{target}$ but with opposite sign) in that case, $D_1$, can be derived by rearranging equation (12) to give:

$$D_1 = \frac{\left(\frac{T_{1actual}}{F_s} + \frac{td_{tmin}}{2G}\right)d_{tmin}}{\left(I_m + \frac{I_{ss}}{G^2}\right)2G} \tag{18}$$

Where $T_{1actual}$ is the torque provided by the chosen motor at step rate $N_{Max1}$.

Similarly, where the left and right hand sides of equation (17) are equal, an expression for the linear deceleration in that case $D_2$ can be derived by rearranging equation (17) to give:

$$D_2 = \frac{\left(\frac{T_{2actual}}{F_s} + \frac{td_{tmax}}{2G}\right)d_{tmax}}{\left(I_m + \frac{\pi h\rho\left(\frac{d_{tmax}^4 - d_{tmin}^4}{32}\right) + I_{ss}}{G^2}\right)2G} \tag{19}$$

Where $T_{2actual}$ is the torque provided by the chosen motor at step rate $N_{max2}$.

In order to ensure reliable operation, the minimum of $D_1$ and $D_2$ is set to be the maximum deceleration of the web, $D_{max}$.

The maximum acceleration that can be provided can similarly be derived from equations (12) and (17) to provide maximum acceleration with empty and full take-up spools ($A_1$ and $A_2$) as follows:

$$A_1 = \frac{\left(\frac{T_{1actual}}{F_s} - \frac{td_{tmin}}{2G}\right)d_{tmin}}{\left(I_M + \frac{I_{ss}}{G^2}\right)2G} \tag{20}$$

$$A_2 = \frac{\left(\frac{T_{2actual}}{F_s} - \frac{td_{tmax}}{2G}\right)d_{tmax}}{\left(I_M + \pi h\rho + \frac{\left(\frac{d_{tmax}^4 - d_{tmin}^4}{32}\right) + I_{ss}}{G^2}\right)2G} \tag{21}$$

Where $A_1$ is the acceleration in the case of an empty spool, and $A_2$ is the acceleration in the case of a spool of maximum diameter. Again, the maximum operational acceleration $A_{max}$ is set to be equal to the minimum of $A_1$ an $A_2$ to ensure reliability.

It is necessary to select a step rate $R_p$ at which the motor should begin stepping when operation of the labelling machine begins. This is achieved by determining the maximum required torque given by equations (12) and (17) above. This provides a maximum torque value (usually referred to as "pull in" or "starting" torque) which can be used to determine the step rate $R_p$ at which the motor should begin stepping by referring to manufacturer's data for the selected motor. When the step rate $R_p$ has been determined, an initial linear speed U (in $mms^{-1}$) at which the web should be moved can be determined according to equation (22):

$$U = \frac{\pi d_t R_p}{G N_{revolution}} \tag{22}$$

The preceding description of selection of the stepper motor 40 and the determination of operating parameters of the labelling machine (for example maximum acceleration and deceleration) need generally only be carried out once, as part of the design process of the labelling machine, and need not be repeated during operation. During the design process parameters such as the height of the web (h) and the maximum diameter of the take up spool 32 are set to be maxima for which the labelling machine is designed. That said, determination of the maximum acceleration and deceleration (using equations (18), (19), (20) and (21)) can, if desired be repeated at runtime using the maximum diameter of the take-up spool for a particular operation of the labelling machine, and the height of the label web for that operation. The maximum diameter and the height of the web may be determined from operator input to the controller of the labelling machine at run-time.

Operation of the labelling machine discussed above is now described.

First, a supply spool 28 is loaded onto the supply spool support 12. The web 30 is unrolled from the supply spool 28 and hand fed along the label path 16 and onto the take-up spool support 14. The end of the label web is attached to the take-up spool support 14 as described below, and a length of label web is wound around the take-up spool support 14 to begin formation of the take-up spool 32. This process is repeated during operation of the labelling machine if the label web breaks.

When the label web has been attached to the take-up spool support 14, the controller of the labelling machine carries out start-up processing, as is now described with reference to FIG. 8. At step S1 the controller causes the stepper motor 40 to step at a predetermined step rate so as to cause the take-up spool support 14 to rotate causing the web to be moved from the supply spool support 12 to the take-up spool support 14. The number of steps through which the stepper motor 40 turns is counted by a counter which is initialised at step S2.

At step S3 the label pitch is measured, as is described in further detail below.

At step S4 the linear displacement of the web 30 caused by rotation of the stepper motor 40 is determined using the linear displacement sensor 50, which operates in the manner described above. At step S5 a check is carried out to determine whether the web 30 has moved a predetermined linear distance, based upon data provided by the linear displacement sensor 50. If the label web has not moved the predetermined linear distance, processing passes from step S5 back to step S4 where the linear displacement is again determined. When it is determined at step S5 that the web 30 has moved through the predetermined linear distance, processing passes to step S6 where the diameter of the take-up spool 32 is determined with reference to the number of steps through which the stepper motor has turned and the linear displacement of the web, as is described below.

It is to be noted that the diameter of the take-up spool 32 at startup cannot be reliably predetermined. For example, if the web 30 breaks, an operator of the labelling machine may attach the web 30 to the take-up spool support 14 already having some web wound thereon. As such, the start up processing described above may be carried out when the take up spool 32 has differing diameters, making determination of take up spool diameter 32 highly desirable.

As described above, the take up spool diameter is determined with reference to operation of the stepper motor 40. The stepper motor 40 rotates to feed the web 30 of labels along the web path 16 while the linear displacement sensor 50 senses the displacement of the web 30 along the path 16. The number of steps ($N_{moved}$) which the motor 40 is turned is determined using the counter initialised at step S2. As described above the associated linear displacement (x) of the web 30, is predetermined. The controller is provided with data relating to the number of steps ($N_{revolution}$) equating to one single revolution of the stepper motor 40.

Having values for linear displacement of the web 30 (x), the number of steps moved by the stepper motor 40 ($N_{moved}$) and the number of steps in a single revolution of the motor 40 ($N_{revolution}$), the controller calculates the diameter of the take-up spool support 32 ($d_t$) using the following equation:

$$d_t = \frac{(x(N_{revolution}))}{(\pi(N_{moved}))} G \tag{23}$$

Where G is a gear ratio of the drive between the take-up spool support 14 and the stepper motor 40, as described above.

In alternative embodiments, the determination of the take-up spool diameter may be modified such that the stepper motor 40 is turned through a predetermined number of steps, and the linear distance through which the web 30 is caused to move by movements of the stepper motor through that predetermined number of steps is measured by the linear displacement sensor 50. In such a case it will be appreciated that the diameter of the take up spool can still be determined using equation (23) above.

The diameter of the supply spool 28 can also be determined as part of the start-up operation of the labelling machine.

Figure 9:
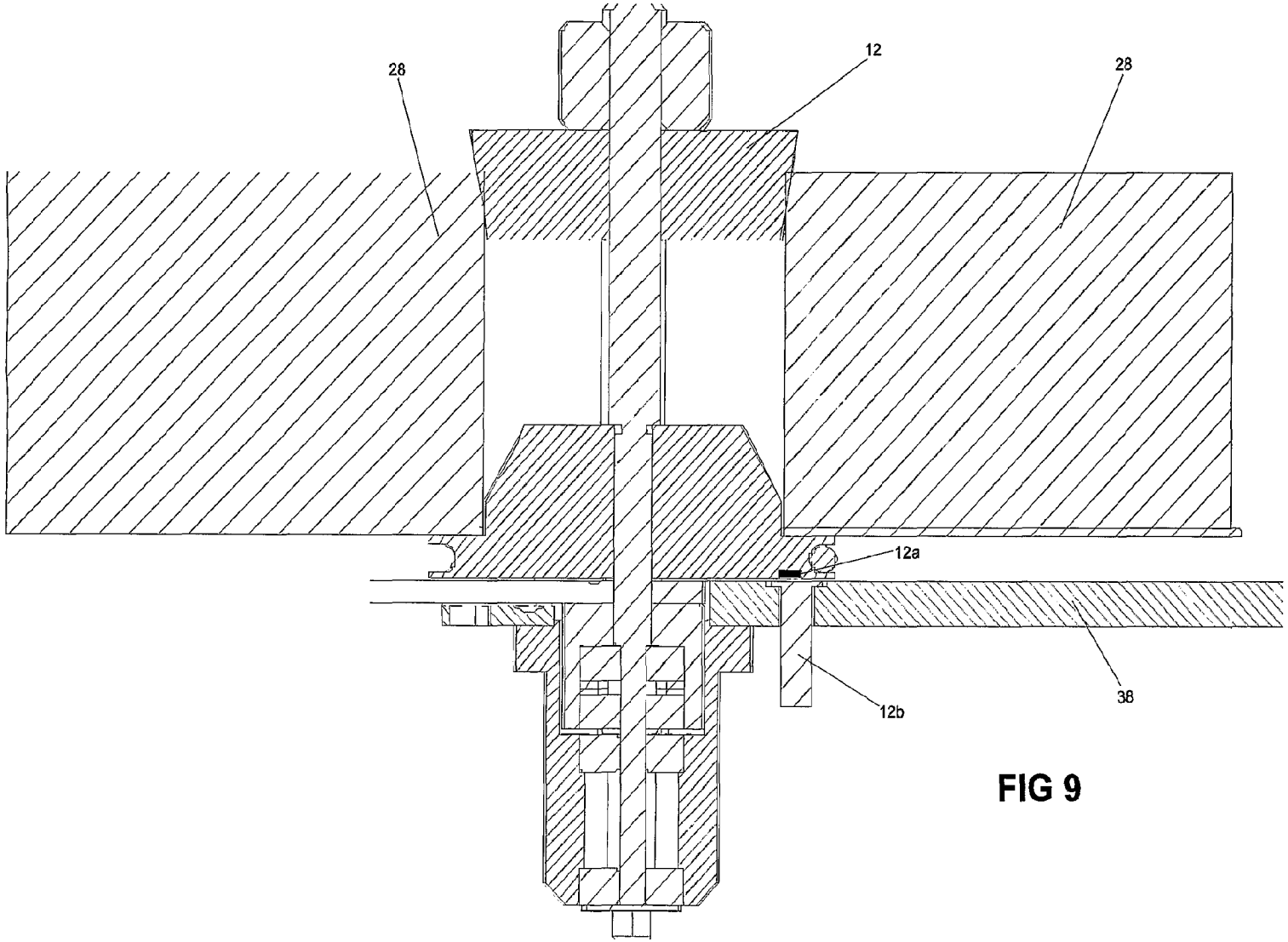
FIG. 9 is an enlarged cross-sectional view of the supply spool support shown in FIGS. 1, 2 and 4A.

FIG. 9 shows a cross section through the supply spool 28 and the supply spool support 12. The supply spool support 12 is provided with a magnet 12*a*. A reed sensor 12*b* is positioned on the platform 38. The magnet 12*a* rotates with the supply spool support 12, and presence of the magnet 12*a* is detected once per rotation of the supply spool support 12 by the reed sensor 12*b*. The number of detections of the magnet 12*a* by the reed sensor 12*b* is monitored. By using this data together with data indicating a number of steps through which the stepper motor 40 has been driven to cause the monitored rotations of the supply spool support 12, the diameter of the supply spool 28 can be determined as is now described.

The circumference of the take up spool 32 ($C_t$) is given by:

$$C_t = \pi d_t \tag{24}$$

The length of web taken up by the take up spool 32 is given by:

$$\left(\frac{N_{moved}}{N_{revolution}}\right)\frac{\pi d_t}{G} \tag{25}$$

Where $d_t$, $N_{moved}$, $N_{revolution}$ and G are as defined above.

The length of web taken up on the take up spool 32 is equal to the length of web paid out by the supply spool 28. The circumference of the supply spool 28 is given by:

$$C_s = \pi d_s \tag{26}$$

Where $C_s$ is the circumference of the supply spool and $d_s$ is the diameter of the supply spool.

It can be seen that the following relationship can be defined:

$$N(\pi d_s) = \left(\frac{N_{moved}}{N_{revolution}}\right)\frac{\pi d_t}{G} \tag{27}$$

Where N is the number of revolutions of the supply spool support 12 monitored with reference to the magnet 12*a* and reed sensor 12*b*.

Given that only whole revolutions of the supply spool can be monitored, it will be appreciated that there is an assumption that the monitoring carried out corresponds to a whole number of revolutions of the supply spool support 12. If, in fact, the supply spool has not turned through a whole number of revolutions, the relationship of equation (27) is a workable approximation, although not completely mathematically accurate. Rearranging equation (27) gives:

$$d_s = \left(\frac{N_{moved}}{N_{revolution}}\right)\frac{d_t}{NG} \tag{28}$$

Substituting equation (23) into equation (28) gives:

$$d_s = \left(\frac{N_{moved}}{N_{revolution}}\right)\frac{(x(N_{revolution}))}{N(\pi(N_{moved}))} \tag{29}$$

Which simplifies to give:

$$d_s = \frac{x}{N\pi} \tag{30}$$

It will be appreciated that equation (30) can be used to determine the diameter of the supply spool 28 either by determining the number of revolutions N of the supply spool associated with movement through a predetermined distance x or by determining the distance x through which the web moves during a predetermined number of revolutions N of the supply spool.

The movement of the supply spool 28 may be somewhat erratic due to movement of the dancer arm 18*a*, which causes the quantity of web in the web path to vary. As such, web dispensed by the supply spool 28 is not necessarily all taken up on the take-up spool 32 if the web path is made longer by movement of the dancer arm 18*a*. Similarly more web may, over a particular period of time, be taken up on the take up spool 32 than is dispensed by the supply spool 28 because of a shortening of the length of the web path caused by movement of the dancer arm 18*a*. To mitigate for the varying length of the web path caused by movement of the dancer arm 18*a*, it is preferred that the number of revolutions N of the supply spool 28 which is used in the preceding calculations should provide data indicating an average number of revolutions. Five revolutions of the supply spool 28 (i.e. N=5) is considered to be a suitable number.

It should be appreciated that determination of the diameter of the supply spool 28 is not required to properly control movement of the web 30, but is useful in providing information to an operator indicating a current quantity of web on the supply spool 28. This is discussed further below.

Referring back to FIG. 8, at step S3 label pitch is measured, as is now described in further detail with reference to FIG. 10. At step S8 a check is carried out to determine whether the label position sensor 52 has detected a label edge. FIG. 11 is a graph showing how the output of the label position sensor 52 varies as the web 30 passes the label position sensor 52. It can be seen that, as described above with reference to FIG. 7, the label position sensor 52 outputs a relatively high signal when a gap between labels 76*a* passes the label position sensor 52, and a relatively low signal when a label 74 passes the label position sensor 52. The check of step S8 is therefore checking for a change in the signal provided by the label position sensor 52, which change may be from a relatively high signal to a relatively low signal, or from a relatively low signal to a relatively high signal.

When an edge is detected (i.e. a change in the output of the label position sensor 52 is detected) at step S8, processing passes to step S9. Here a check is carried out to determine whether the change is from a relatively high signal to a relatively low signal, indicating that a leading edge of a label has passed the label position sensor 52. If this is the case, processing passes to step S10, where the label length is measured using the linear position sensor 50 in the manner described above. This measurement is carried out by measuring linear displacement of the web using the linear position sensor 50 until a further edge is detected at step S11. An edge is detected at step S11 when the signal provided by the label position sensor 52 changes from a relatively low signal to a relatively high signal. When a edge is detected at step S11, processing passes to step S12. Here, a parameter $L_l$ is set to be equal to the measured displacement, which indicates the length of the label.

At step S13 a check is carried out to determine whether the length of the gap 76*a* between two adjacent labels has been measured, if this is not the case, processing passes to step S14. Processing similarly passes from step S9 to step S14 when the change in signal detected at step S8 is determined to be a change from a relatively low signal to a relatively high signal.

At step S14 the length of the gap 76*a* is measured using the linear position sensor 50. At step S15 a check is carried out to determine whether a further edge has been detected, this time by the signal output by the label position sensor 52 changing from a relatively high signal to a relatively low signal. If an edge is detected at step S15, processing passes to step S16 where a parameter $L_g$ is set to be equal to the measured displacement, which indicates the length of a gap between adjacent labels.

At step S17 a check is carried out to determine whether the label length has been measured. If this is not the case, processing passes from step S17 to step S10.

When it is determined at step S13 that the gap length has been measured, or when it is determined at step S17 that the label length has been measured processing passes to step S18. Here the label pitch, $L_p$, is set to be the sum of the gap length, $L_g$, and the label length, $L_l$.

It will be appreciated that the processing described above requires that at least one label passes the label position sensor 52. In preferred embodiments of the invention a number of labels are passed past the label position sensor 52 and a number of measurements are obtained for both label length $L_l$ and gap length $L_g$ and averaged so as to improve accuracy.

Figure 8:
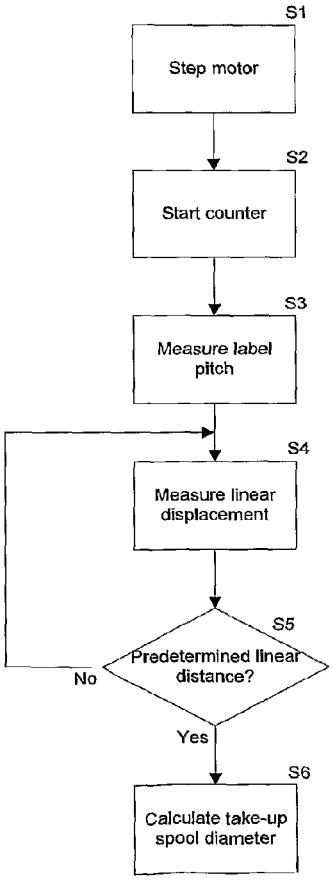
FIG. 8 is a flow chart showing start-up processing carried out by the described labelling machine.
Figure 10:
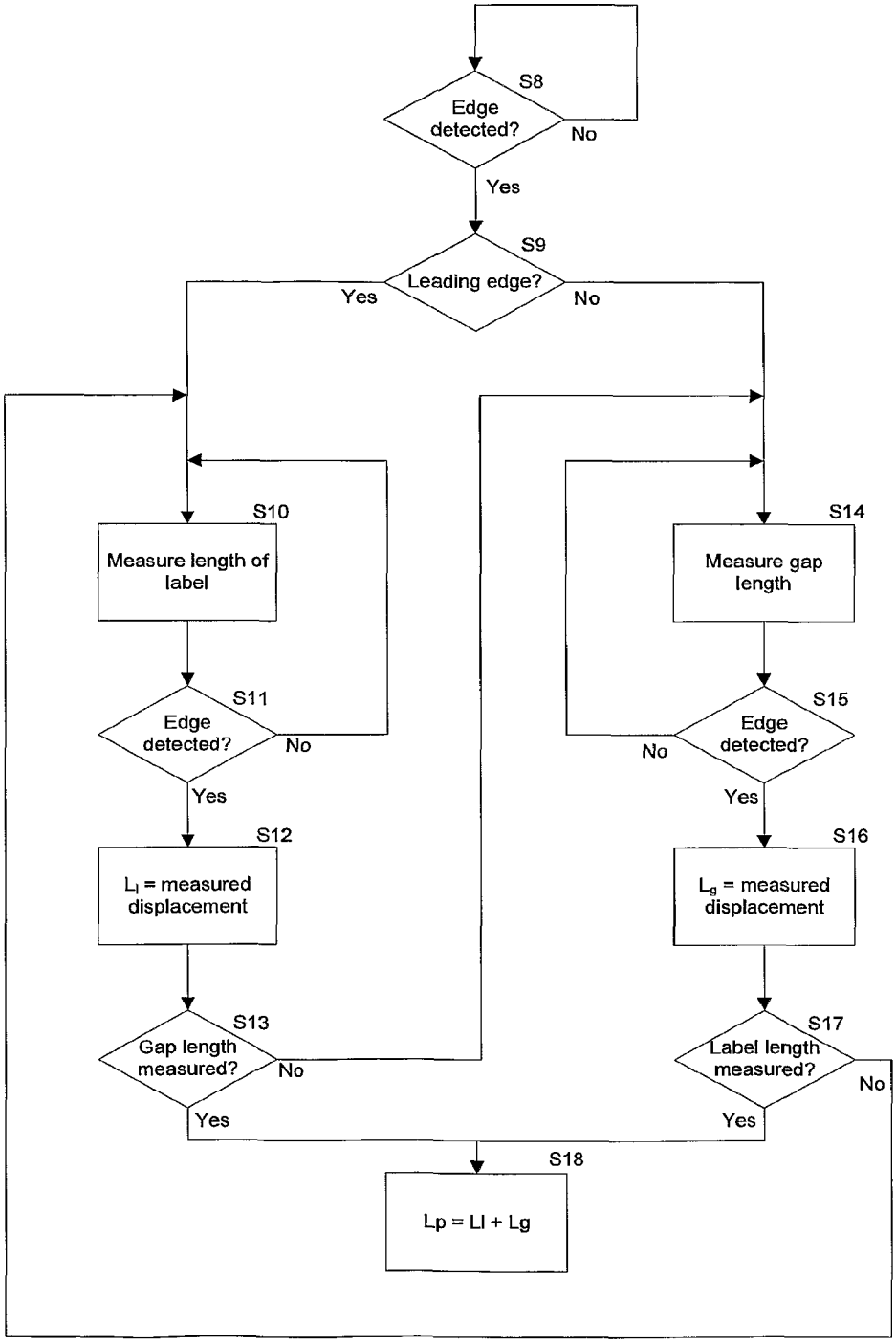
FIG. 10 is a flow chart showing processing carried out to determine label pitch, label length and gap length in the processing of FIG. 8.

It will be appreciated that the processing of FIG. 10 can be carried out in parallel to that of FIG. 8. That is, the processing required to determine label pitch can be carried out while the controller is also carrying out the processing necessary to determine take up and supply spool diameters. Such parallel processing is advantageous because the length of web which needs to be moved during the start up processing is minimised. This is particularly advantageous given that any labels dispensed from the label separating beak as the web is moved during start-up processing are wasted.

At the end of the start up processing described with reference to FIG. 8, the web 30 is positioned such that an edge of a label is aligned with the peel beak 24. This is achieved by processing which is now described with reference to FIG. 12.

At step S20 a leading edge offset is calculated. The leading edge offset indicates a length of web that should be fed after a leading edge of a label has been detected by the label position sensor 52, so as to cause a leading edge of a label to be aligned with the edge of the label separating beak 24. It will be appreciated that where the distance between the peel beak 24 and label position sensor 52 is equal to a whole number of label pitches, the leading edge offset can be set to zero. More generally, the leading edge offset is given by equation (31):

$$E_o = \text{mod}\ [D_b, L_p] \tag{31}$$

Where $E_o$ is the leading edge offset in millimetres;

$D_b$ is the distance between the label position sensor 52 and the edge of the label separating beak (in mm);

$L_p$ is the label pitch (in mm), determined as described above; and mod [a,b] is a function returning the remainder resulting from the division of a by b.

Having determined the leading edge offset, the number of steps through which the stepper motor 40 should be turned is determined at step S21. This determination is carried out using equation (32):

$$N_o = E_o \frac{N_{revolution}}{\pi d_t} G \tag{32}$$

where:

$N_o$ is the number of steps through which the stepper motor 40 should be turned; and $E_o$, $N_{revolution}$, $d_t$ and G are as defined above.

The stepper motor is then controlled to turn through the determined number of steps $N_9$ using processing described in further detail below.

At step S22 operation of the label position sensor 52 is disabled, before the web is appropriately fed at step S23. The processing of step S23 is carried out according to the processing shown in FIG. 14, beginning at step 35. The label position sensor 52 is disabled at step S22 given that detection of a label edge normally affects the processing shown in FIG. 14, but should not do so here given that the controller is feeding the web so as to properly position the web for the dispensing of labels, and detection of further label edges should not affect this feeding of the web.

In alternative embodiments equation (32) may be applied replacing $E_o$ with $D_b$, thereby ensuring that the edge of the label currently sensed by the label position sensor 52 is moved to the edge of the label separating beak.

Having carried out start-up processing of the type described above, operation of the labelling machine to dispense labels can begin.

The controller determines a linear speed $V_t$ at which the web is to be fed. In some applications it is necessary for this linear speed to match the speed at which a product is conveyed past the labelling machine by a conveyor. The speed at which the product is conveyed past the labelling machine can be provided as an input to the controller from an encoder. The encoder may be attached to a wheel of known diameter which runs against the conveyor such that the linear movement of the wheel matches the linear movement of the conveyor. The encoder can thus provide details of a distance through which the wheel has turned. Given knowledge of the time taken to travel that distance, the speed of the conveyor can easily be determined.

In alternative applications the speed at which the web is to be moved may be input to the controller by an operator, as a manual input.

Operation of the labeller is normally initiated by a product sensor being triggered indicating that a product is approaching the labelling machine. It is preferred that the controller is programmed with a so-called "registration delay". Such a registration delay can indicate a time which should elapse (monitored by a simple timer) after detection of the product by the product sensor before the labelling process begins, or alternatively indicate a distance through which the conveyor should move (as monitored by the encoder) before the labelling process begins. The registration delay may be input to the controller by an operator of the labelling machine. It will be appreciated that by adjusting the registration delay, the position at which a label is affixed to a passing product may be adjusted.

Figure 13:
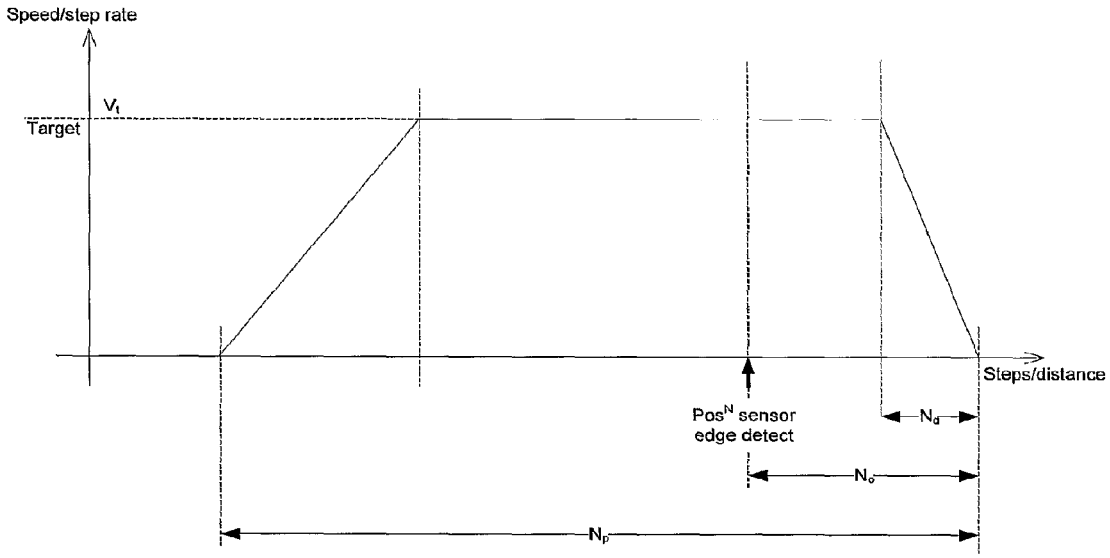
FIG. 13 is a speed/distance graph for a typical label feed operation.

Movement of the web during a label feed operation is illustrated by the speed/distance graph of FIG. 13. It can be seen that the total distance through which the web is moved in dispensing a single label is indicated $N_p$, denoting that the stepper motor turns through $N_p$ steps to cause the web movement. Having detected a label edge, the stepper motor turns through $N_o$ steps before the web comes to rest, where $N_o$ is determined as described below to ensure that a label edge is aligned with the edge of the label separating beak 24.

The web is accelerated from rest to the target speed $V_t$. The web then moves at the target speed $V_t$ before being decelerated to rest. $N_d$ indicates the number of steps through which the stepper motor 40 turns to decelerate the web 30. It will be appreciated that the numbers of steps $N_p$ $N_o$ and $N_d$ are determined with reference to the diameter of the take-up spool $d_t$ as is now described. Although the graph of FIG. 13 shows a simple speed/distance profile for the web 30, it will be appreciated that in some circumstances different speed/distance profiles may be appropriate. In particular, it may sometimes be appropriate to vary the target speed $V_t$ as the web is moved.

Figure 14:
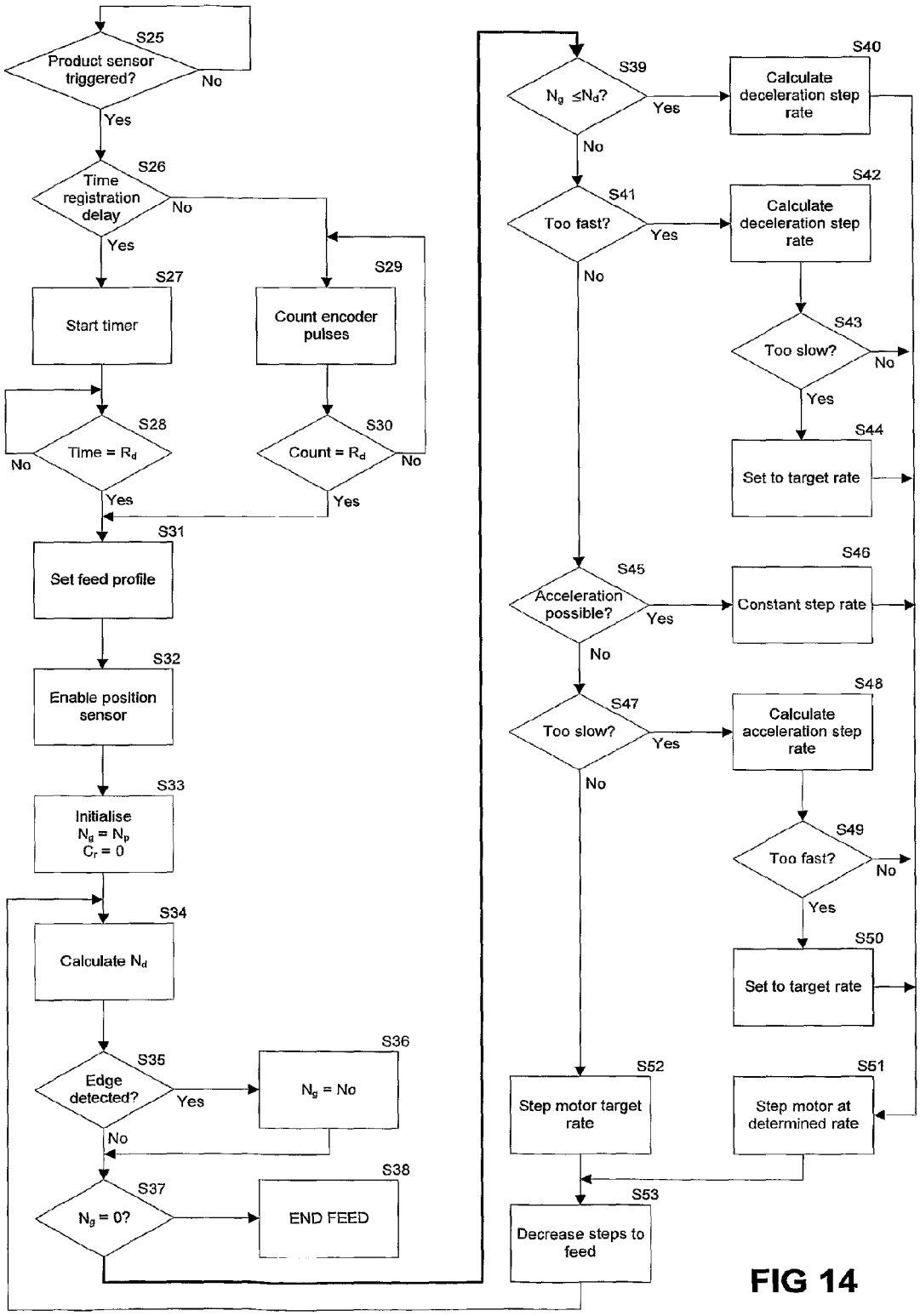
FIG. 14 is a flow chart of processing carried out during the label feed operation of FIG. 13.

FIG. 14 is a flow chart showing operation of the labelling machine to feed a single label. Processing begins at step S25 where a check is carried out to determine whether the product sensor has been triggered by a passing product. If this is the case, processing passes to step S26 otherwise, processing remains at step S25 until the product sensor is triggered by a passing product.

At step S26 a check is carried out to determine how the registration delay $R_d$ is specified. If the registration delay is a time delay, processing passes from step S26 to step S27 where a timer is initialised. Processing then passes to step S28 where a check is carried out to determine whether the elapsed time is equal to the registration delay $R_d$. Processing remains at step S28 until the elapsed time is equal to the registration delay $R_d$.

If the check of step S26 indicates that the registration delay $R_d$ is not a time delay, processing passes to step S29. At step S29 pulses provided by the encoder discussed above are counted. At step S30 a check is carried out to determine whether the number of pulses received is equal to the distance which corresponds to the registration delay $R_d$. If this is not the case processing returns from step S30 to step S29 and a loop is thereby established until the conveyor has moved through the distance specified by the registration delay $R_d$.

When the time or distance of the registration delay has passed, processing passes from step S28 or step S30 to step S31, where the controller calculates various parameters required to define the way in which the web will be moved. More particularly the controller computes the numbers of steps $N_p$ through which the stepper motor is to be turned to cause the desired movement of the web, the number of steps $N_o$ through which the stepper motor should be turned after detection of an edge so as to allow a label edge to be properly aligned with the label separating beak 24, and the step rate $M_r$ at which the stepper motor 40 should be turned given the desired linear web speed which is determined as described above.

The total number of steps $N_p$ through which the stepper motor is to be turned is given by equation (33)

$$N_p = L_p \frac{N_{revolution} G}{\pi d_t} \tag{33}$$

where the parameters have the definitions given above.

It will be recalled that the distance $E_o$ through which the web should be fed following detection of an edge was determined by equation (31) as part of the start-up processing. This distance $E_o$ can be converted into a number of steps $N_o$ using equation (34):

$$N_o = E_o \frac{N_{revolution} G}{\pi d_t} \tag{34}$$

The step rate $M_r$ at which the stepper motor 40 should step is determined with reference to the desired linear speed of the web $V_t$ which as described above can either by input by an operator, or alternatively determined using an encoder. The step rate $M_r$ is given by equation (35):

$$M_r = V_t \frac{N_{revolution} G}{\pi d_t} \tag{35}$$

Figure 12:
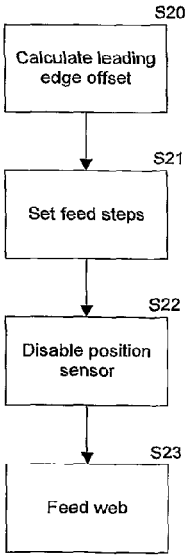
FIG. 12 is a flow chart showing processing carried out to determine a leading edge offset used to position the label web relative to a label separating beak.

Referring again to FIG. 14, having determined the necessary parameters at step S31, processing passes to step S32 where the label position sensor 52 is enabled. Enabling of the label position sensor 52 at step S32 is required because of the disabling of the label position sensor 52 at step S22 of FIG. 12, given that the label position sensor needs to be enabled to allow proper dispensing of labels according to the processing of FIG. 14. At step S33, the number of steps $N_g$ remaining in the current feed is set to be equal to the total number of steps $N_p$ in a single label feed. A parameter $C_r$ indicating the current step rate is initialized to a value of zero.

Processing passes from step S33 to step S34 where a number of steps $N_d$ required to decelerate the web from its current speed to rest is determined. The maximum deceleration $D_{max}$ is determined using equations (18) and (19) set out above. The linear distances through which the web is moved to decelerate from a current linear speed $V_c$ to a target linear speed $U_t$ is given by the familiar equation:

$$U_t^2 = V_c^2 - 2D_{max}s \tag{36}$$

Where s represents distance.

Given that the target linear speed $U_t$ is zero, and rearranging equation (36), the following expression for the linear distance s can be derived:

$$s = \frac{V_c^2}{2D_{max}} \tag{37}$$

The linear distance s can be converted into a number of steps $N_d$, such that equation (37) becomes:

$$N_d = \left(\frac{V_c^2}{2D_{max}}\right)\left(\frac{N_{revolution} G}{\pi d_t}\right) \tag{38}$$

Processing passes from step S34 of FIG. 14 to step S35. At step S35 a check is carried out to determine whether the label position sensor 52 has detected a label edge. If this is the case, processing passes from step S35 to step S36 where the number of steps remaining in the current label feed $N_g$ is set to be equal to the number of steps $N_o$ through which the web should be moved to align a label edge with the peel beak. Processing then passes to step S37. If a label edge has not been detected by the label position sensor 52, processing passes directly from step S35 to step S37.

At step S37 a check is carried out to determine whether the number of steps remaining in the current feed is equal to zero. If this is the case processing passes to step S38 where the feed ends. If this is not the case, processing passes to step S39 where a check is carried out to determine whether the number of steps remaining in the current label feed $N_g$ is less than or equal to the number of steps $N_d$ required to decelerate the web. If this is the case, processing passes to step S40 where a deceleration step rate is determined.

The deceleration step rate is determined by determining the lowest rate $C_{r+1}$ at which the motor can be caused to step, given the limitation of the maximum possible deceleration $D_{max}$ and the current step rate $C_r$. It is determined using equation (39):

$$C_{r+1} = \sqrt{C_r^2 - \frac{2D_{max} N_{revolution} G}{\pi d_t}} \tag{39}$$

Equation (39) is based upon equation (36) which can be expressed as follows:

$$V_{c+1}^2 = V_c^2 - 2D_{max}S_w \tag{40}$$

where $V_c$ is the current linear web speed;

$V_{c+1}$ is the new linear web speed; and $S_w$ is the linear distance through which the web is moved in a single step.

Equation (40) can be rearranged to give:

$$V_{c+1}=\sqrt{V_c^2-2D_{max}S_w} \tag{41}$$

The linear distance $S_w$ through which the web is moved in a single step is given by equation (42):

$$S_w = \frac{\pi d_t}{N_{revolution}G} \tag{42}$$

The new linear web speed can be related to a step rate using equation (43):

$$V_{c+1} = \frac{C_{r+1}\pi d_t}{N_{revolution}G} \tag{43}$$

Equation (43) can be rearranged to give:

$$C_{r+1} = V_{c+1}\frac{N_{revolution}G}{\pi d_t} \tag{44}$$

Substituting equation (41) into equation (44) gives:

$$C_{r+1} = \sqrt{V_c^2 - 2D_{max}S_w}\left(\frac{N_{revolution}G}{\pi D_t}\right) \tag{45}$$

The current linear web speed $V_c$ is related to the current step rate by equation (46):

$$V_c = \frac{C_r\pi d_t}{N_{revolution}G} \tag{46}$$

Substituting equations (42) and (46) into equation (45) gives:

$$C_{r+1} = \left(\sqrt{\left(\frac{C_r\cdot\pi d_t}{N_{revolution}G}\right)^2 - 2D_{max}\frac{\pi d_t}{N_{revolution}G}}\right)\frac{N_{revolution}G}{\pi d_t} \tag{47}$$

Equation 47 can be rearranged to give equation (39), viz:

$$\begin{aligned}
C_{r+1}^2 &= \left(\left(\frac{C_r\cdot\pi d_t}{N_{revolution}\cdot G}\right)^2 - 2D_{max}\frac{\pi d_t}{N_{revolution}\cdot G}\right)\cdot\left(\frac{N_{revolution}\cdot G}{\pi d_t}\right)^2 \\
&= \left(\frac{(C_r\cdot\pi d_t)^2}{(N_{revolution}\cdot G)^2} - 2D_{max}\frac{\pi d_t}{N_{revolution}\cdot G}\right)\cdot\frac{(N_{revolution}\cdot G)^2}{(\pi d_t)^2} \\
&= \left(\frac{C_r^2\cdot\pi d_t^2}{(N_{revolution}\cdot G)^2} - 2D_{max}\frac{\pi d_t}{N_{revolution}\cdot G}\right)\cdot\frac{(N_{revolution}\cdot G)^2}{(\pi d_t)^2} \\
&= \left(\frac{C_r^2}{(N_{revolution}\cdot G)^2} - 2D_{max}\frac{1}{N_{revolution}\cdot G\cdot\pi d_t}\right)\cdot(N_{revolution}\cdot G)^2 \\
&= C_r^2 - 2D_{max}\frac{N_{revolution}\cdot G}{\pi d_t}
\end{aligned}$$

$$\therefore C_{r+1} = \sqrt{C_r^2 - \frac{2D_{max}N_{revolution}G}{\pi d_t}} \tag{39}$$

Referring back to FIG. 14, having determined a step rate to effect deceleration at step S40, processing passes to step S51, which is described in further detail below.

If the check of step S39 determines that the number of steps remaining in the current label feed $N_g$ is not less than or equal to the number of steps $N_d$ required to decelerate the web, processing passes to step S41. At step S41 a check is carried out to determine whether the current step rate is too fast. This check determines whether the inequality of equation (48) is true:

$$C_r > M_r \tag{48}$$

The check of step S39 is required to ensure proper operation where the target speed $V_t$ and consequently the target step rate $M_t$ varies during movement of the web. If it were the case that the target step rate did not vary, the check of step 39, need not be carried out.

If this is the case, processing passes from step S41 to step S42, where a step rate to effect deceleration is calculated using equation (39) set out above. Processing passes from step S42 to step S43 where a check is carried out to determine whether the step rate determined at step S42 is less than the target step rate $M_r$ if this is the case, the step rate is set to be equal to the target step rate $M_r$ at step S44. Processing passes from step S44 to step S51, otherwise, processing passes directly from step S43 to step S51.

If the check of step S41 indicates that the step rate is not too high, processing passes from step S41 to step S45. At step S45 a check is carried out to determine whether it is possible to accelerate the web, and still have a sufficient number of steps to decelerate the web to rest, given the number of steps $N_g$ remaining in the current feed. This is determined by determining whether the number of steps $N_g$ remaining in the current feed is equal to one more than the number of steps required to decelerate the web to rest. If this is the case, it is determined that the web should not be accelerated, and processing passes to step S46 where the step rate is set to remain constant, before processing passes to step S51.

If the check of step S45 is not satisfied (i.e. acceleration can be carried out while still allowing sufficient steps for deceleration of the web to rest), processing passes from step S45 to step S47. Here a check is carried out to determine whether the current step rate is less than a target step rate. If this is the case, a step rate to effect acceleration is calculated at step S48, according to equation (49):

$$C_{r+1} = \sqrt{C_r^2 + \frac{2A_{max}N_{revolution}G}{\pi d_t}} \tag{49}$$

where $A_{max}$ is the maximum possible acceleration.

It can be seen that equation (49) has a similar form to equation (39) and its derivation therefore has the general form set out above.

Processing passes from step S48 to step S49 where a check is carried out to determine whether the step rate $C_{r+1}$ calculated at step S48 exceeds the target step rate $M_r$. If this is the case, the step rate $C_{r+1}$ is set to be equal to the target step rate at step S50, before processing passes from step S50 to step S51. If the step rate $C_{r+1}$ calculated at step S48 does not exceed the target step rate $M_r$ processing passes directly from step S49 to step S51. At step S51 the motor is caused to turn one step at the determined step rate.

If the check of step S47 determines that the current step rate is not too slow, processing passes from step S47 to step S52. It is known (given operation of steps S41 and S47 that the step rate is equal to the target step rate, and the motor is turned through one step at that step rate at step S52.

Processing passes from each of steps S51 and S52 to step S53 where the number of steps remaining in the current feed $N_g$ is decremented by one, before processing returns to step S34.

Referring generally to the flow charts of FIGS. 8, 10, 12, 14, it can be seen that FIG. 8 shows general start-up processing while FIG. 10 shows part of the processing of FIG. 8 in further detail. FIG. 12 shows processing carried out at the end of the start up processing, while FIG. 14 shows general operation of the labelling machine to dispense labels. It will be appreciated that the processing of FIG. 14 is repeated for each label which is dispensed.

It was described above that the start-up processing included determination of the diameter of both the take-up spool 32 and the supply spool 28. It will be appreciated that the processing described above to determine spool diameters is carried out on an ongoing basis during operation of the labelling machine so that an up to date measure of the diameter $d_t$ of the take-up spool 32 is maintained for use in the processing described with reference to FIG. 14. It will be appreciated that to monitor the diameter of the take-up spool 32 on an on-going basis there is no need for the linear distance of web movement or number of steps through which the motor turns to be predetermined. Instead, by monitoring the linear distance using the linear displacement sensor 50, and by monitoring the number of steps through which the motor turns, the controller is able to determine the diameter $d_t$ of the take-up spool 32 using equation (23) set out above. In this way the controller is configured to maintain a sufficiently accurate measure of the diameter of the take-up spool, such that rotational speed and position of the motor can be related to linear speed and position of the web in the manner described above.

Over time, it will be appreciated that the supply spool 28 will become exhausted and it is preferable for the labelling machine to provide an indicative warning signal shortly before the supply spool 28 becomes exhausted. Such an indication can take the form of a visual indication provided on a display device of the labelling machine, or an audio indication, and/or a control signal for use in the control of associated plant and equipment.

Given that an operator may not load a full supply spool of labels, it is not preferred to assume a known quantity of labels on a supply spool and simply count them each cycle, but instead it is preferable to determine the diameter of the supply spool and configure the controller to assert the warning signal when the supply spool diameter falls below a pre-programmed limit. On-going determination of the diameter of the supply spool 28 can be carried out using the methods described above with reference to FIG. 9. In a preferred embodiment, the controller is configured to continuously receive the signal from the reed sensor 12*b*, so that the controller detects and counts the number of revolutions N of the supply spool. By monitoring web displacement (x) using the linear position sensor 50 the controller is able to determine the supply spool diameter by performing the calculation according to equation (30). The controller is therefore able to continually determine supply spool diameter while the labelling machine is in use.

If the linear displacement sensor 50 fails to detect movement of the web 30 when the stepper motor 40 is actuated to drive the web 30, the stepper motor 40 is stopped and a fault is signalled (e.g. broken web). Similarly, if the linear displacement sensor 50 fails to detect an expected amount of movement of the web 30 when the stepper motor 40 is actuated to drive the web 30, the stepper motor 40 is stopped and a fault is signalled (e.g. broken web). If the label sensor 52 does not detect a label edge when it is expected, the stepper motor 40 continues to the end of that label feed as defined by $N_p$.

As described above with reference to FIGS. 1 and 2, the printer 34 is moveable between a first position, as shown in FIG. 1, in which the printing head 36 overlies the printing substrate support 22, and a second position, as shown in FIG. 2, in which the printing head 36 does not overlie the printing substrate support 22.

The printing substrate support 22 has a planar surface over which the web 30 travels. With the printer 34 in the first position, the web 30 is decelerated to dispose the leading label to underlie the print head 36 when in the first position. The web 30 is accelerated to a predetermined speed before being decelerated again to position the following label to underlie the print head 36, and so on. The label may be accelerated during printing. The timing of the deceleration and acceleration of the web is controlled by the controller and determined by the output of the label position sensor 52 and the linear displacement sensor 50, as described above. The controller ensures that the web 30 stops after a first label has been peeled from the web 30 but before a subsequent label reaches the beak as described above. In this way, the labelling machine is able to use the printer 34 to print information onto a label before the label is dispensed.

Figure 2:
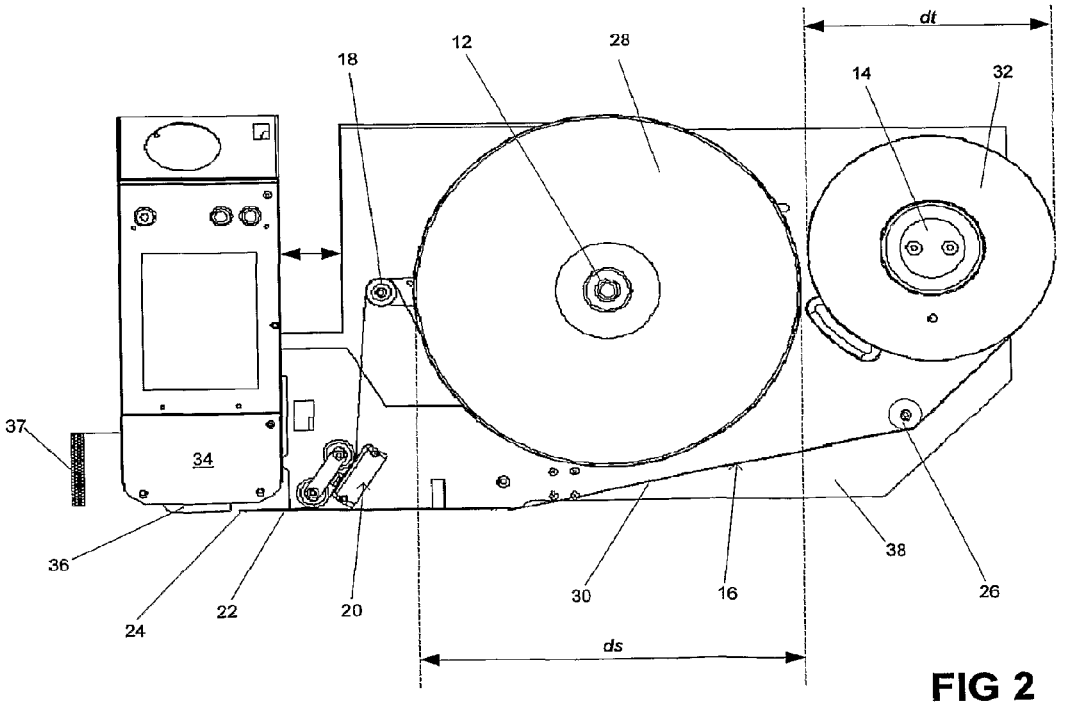
FIG. 2 is a schematic drawing in plan view of the labelling machine of FIG. 1 showing the printer in a second position.

The described labelling machine, is also adaptable for use with a supply spool 28 carrying a web 30 of pre-printed labels. In this case the printer is positioned in the second position, as shown in FIG. 2, in which the printing head 36 is removed from the printing substrate 22. It will be appreciated in that where the labels on the web are pre-printed descriptions of positioning the web relative to a printhead is not relevant, but positioning relative to the label separating beak 24 (FIG. 1) is required.

Figure 15:
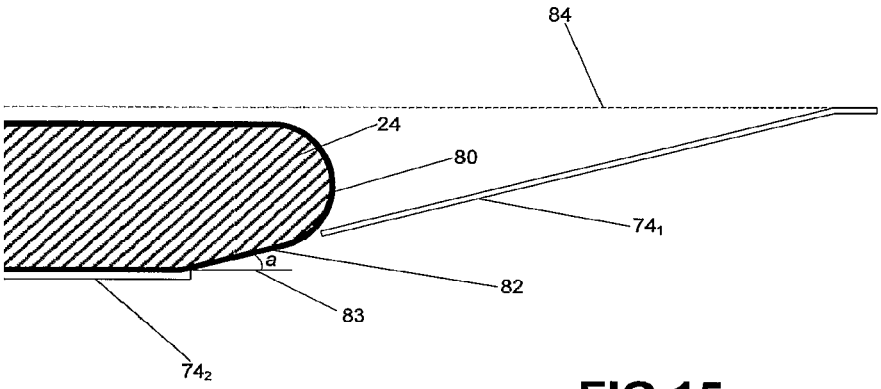
FIG. 15 is a schematic drawing in plan view of a label separating beak according to an embodiment of the present invention.

Referring back to FIG. 5 the label-separating beak 24 is disposed on the peripheral end of the printing substrate support 22. Referring also to FIG. 15, the beak 24 has a rounded end 80 and a separating surface 82 angled at an angle a relative to the web path 83, prior to label separation. The angle a is generally between approximately 10° and 20°, and preferably at approximately 15°, The angled separating surface 82 facilitates separation of the leading label $\mathbf{74}_1$ from the web 30 such that the label $\mathbf{74}_1$ extends in substantially the same plane as the separating surface 82 and thereby facilitates attachment of the label onto a surface 84 of a passing product or container. While the label is fed off the beak and separated the stepper motor 40 decelerates the web 30 to a stop. If necessary, the printer will continue to print a label as the web is decelerated.

Figure 16:
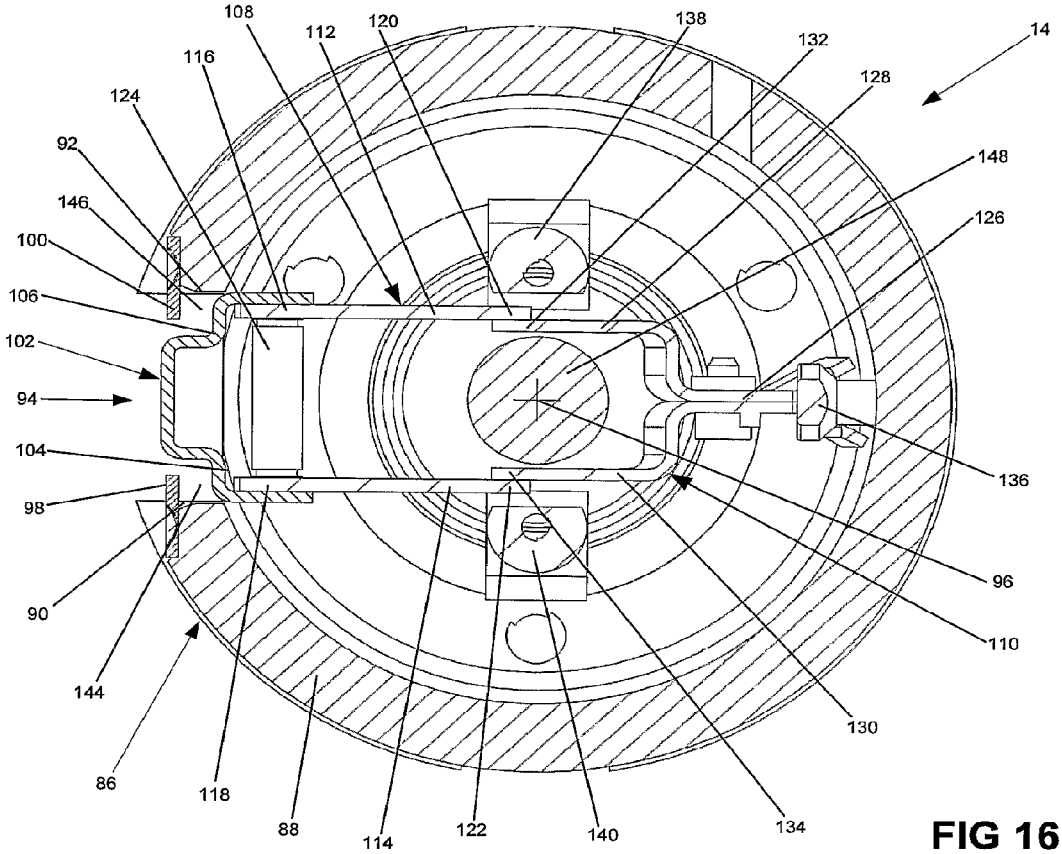
FIG. 16 is a plan view in section of a take-up spool support according to the present invention, with a web attachment opening ready to receive an end portion of a web.
Figure 17:
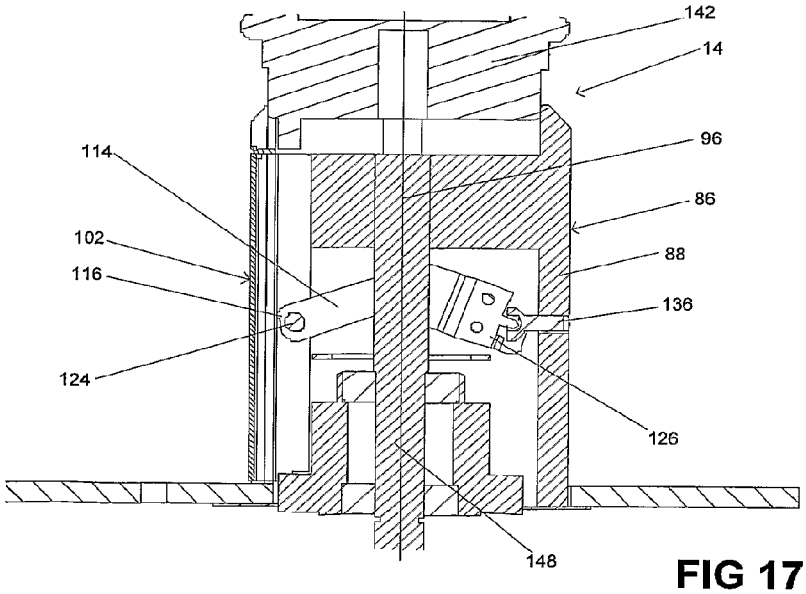
FIG. 17 is an elevation in section of the take-up spool support of FIG. 16.

Referring to FIGS. 16 and 17, the take-up spool support 14 has a partial cylindrical body 86 formed from an incomplete circular wall 88 having a first end 90, and a second end 92 spaced apart to form an opening 94. The body 86 has a longitudinal axis 96. The opening 94 extends along the height of the wall 88 in the direction of the longitudinal axis 96. Each of the first and second ends 90, 92 has an attached abutment, 98 and 100, respectively. The abutments, 98 and 100, extend along the length of the first and second ends 90 and 92 in the direction of the longitudinal axis 96.

The body 86 also has an attachment member 102 having first and second shoulders 104 and 106 extending in parallel along the length of the member 102. The attachment member 102 is disposed within the opening 94 and, in use, is displaceable in a direction perpendicular to the longitudinal axis 96 of the body 86, such that the first and second shoulders 104 and 106 abut the first and second abutments, 98 and 100, respectively.

The take-up spool support 14 further comprises first and second locking members 108 and 110, respectively. The first locking member 108 has first and second parallel arms 112 and 114 that extend adjacent to the opening 94. Each arm has an attachment end, 116 and 118 and an actuator end 120 and 122, respectively. The attachment ends, 116 and 118, are pivotally attached to the attachment member 102 by a pin 124. The pin 124 extends between the attachment ends, 116 and 118, and through apertures in each of the attachment ends. The pin 124 is fixed relative to the attachment member 102 such that the first locking member 108 is able to pivot on the pin 124 relative to the attachment member 102.

The second locking member 110 has an anchor end 126 and extends radially inwards therefrom into first and second spaced parallel arms, 128 and 130. Each of the arms, 128 and 130, has an actuator end, 132 and 134, respectively. The anchor end 126 is pivotally attached to an anchor 136, which is fixed into the internal surface of the wall 88 at a position which diametrically opposes the attachment member 102.

The actuator end 120 of first arm 112 of the first locking member 108, and the actuator end 132 of the first arm 128 of the second locking member 110, are pivotally attached to each other and to a first actuating member 138. Similarly, the actuator ends 122 and 134 of second arm 114 of the first locking member 108, and the second arm 130 of the second locking member 110, are pivotally attached to each other and to a second actuating member 140. The first and second actuating members 138 and 140 extend upwardly therefrom in the direction of the longitudinal axis 96 and are fixed at their opposite ends to a generally cylindrical actuating knob 142 which is seated on top of the wall 88, coaxially with the longitudinal axis 96. The actuating knob 142 is displaceable in the direction of the longitudinal axis 96 in a push-pull manner, such that pulling the actuating knob 142 upwards lifts the actuating members 138 and 140 which thereby lifts the actuating ends 120 and 122 of the first locking member 108, and the actuating ends 132 and 134 of the second locking member 110. Lifting actuating ends 120, 122, 132 and 134 pulls arms 112 and 114 so as to move attachment ends 116 and 118 radially inwards. Therefore, the force induced in the direction of longitudinal axis 96 by pulling knob 142 is translated into a force in a direction perpendicular to the longitudinal axis 96 along a plane which intersects the anchor 136 and the pin 124, such that the attachment member 102 is displaced radially towards the longitudinal axis 96 thereby separating the first and second shoulders 104 and 106 from the first and second abutments 98 and 100, respectively, to form first and second attachment openings 144 and 146, respectively as shown in FIG. 16. The attachment openings 144 and 146 are suitably dimensioned to receive an end portion of the web 30 but are dimensioned to be sufficiently small such that a finger of a user cannot be inserted therein. The attachment openings therefore provide a safe means for attaching the web 30 to the take-up spool support 14.

Figure 18:
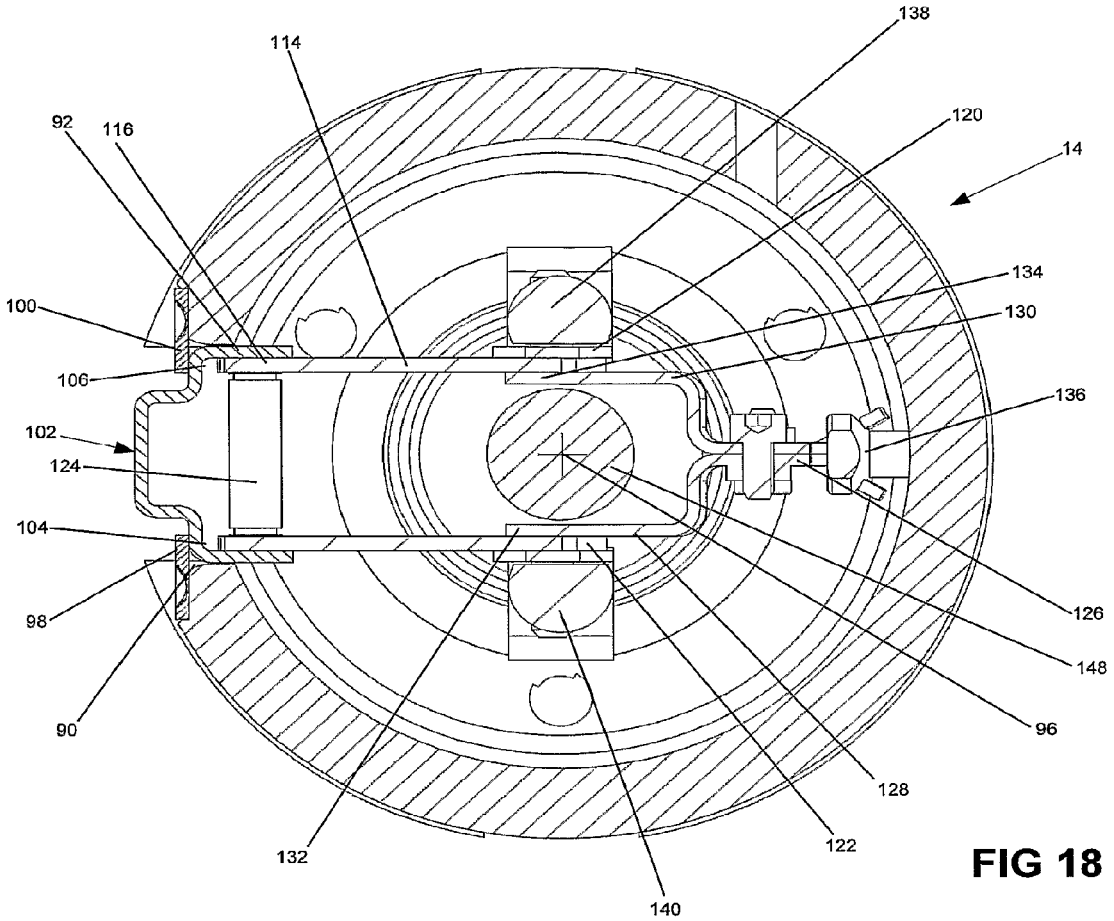
FIG. 18 is a plan view in section of the take-up spool support of FIG. 16, with the web attachment opening closed and locked.
Figure 19:
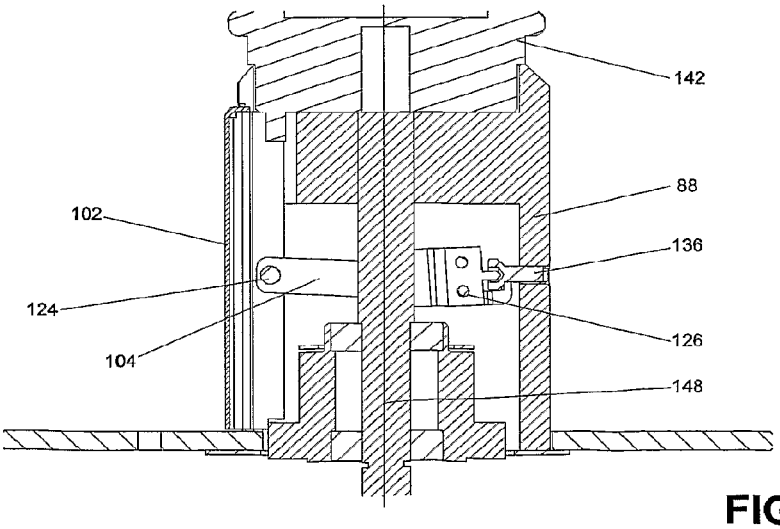
FIG. 19 is an elevation in section of the take-up spool support of FIG. 18.

In use, with the actuating knob 142 pulled outwards the attachment openings 144 and 146 are ready to receive the end portion of the web 30 as shown in FIGS. 16 and 17. The end portion of the web 30 is placed into one of the openings, 144 or 146, and the actuating knob 142 is pushed inwards in the position shown in FIGS. 18 and 19, in the direction of the longitudinal axis 96, such that the actuating members 138 and 140 are pushed downwards thereby also pushing the actuating ends 120, 122, 132 and 134 downwards. Dropping the actuator ends translates the force in the direction of the longitudinal axis 96 into a force in a direction perpendicular to the longitudinal axis 96 along a plane which intersects the anchor 136 and the pin 124, such that the shoulders 104 and 106 of the attachment member 102 are displaced towards the abutments 98 and 100, respectively, thereby securing the end portion of the web 30 therebetween. Pushing the actuating knob 142 pushes the actuating members 138 and 140 and the actuating ends 120, 122, 132 and 134 further outwards over the plane which intersects the anchor 136 and the pin 124 and thereby mechanically locks the attachment member 102 in this position with the end portion of the web securely attached to the take-up spool support 14, as shown in FIGS. 18 and 19. Preferably, the anchor 136 is a threaded component which is provided with a slot in its end so that its position can be adjusted with a screwdriver from an outer part of the takeup spool support. This adjustment allows a clamping force provided between the attachment member 102 and abutments 98, 100 to be varied. More specifically, the clamping force can be set so as to be sufficiently high to allow the label web to be securely attached, while at the same time not being so high that the actuating knob 142 is unnecessarily difficult to operate.

The take-up spool support 14 is driven by a drive shaft 148 coaxial with axis 96, which is connected to the stepper motor by means of a drive pulley and drive belt as described previously with reference to FIGS. 3 and 4.

The take-up spool support 14 is driven by the stepper motor at a relatively high speed and with relatively high torque. The take-up spool support 14, according to the present invention, provides for relatively safe operation and attachment of the web compared with known take-up spool supports.

The embodiment of the invention described herein uses a stepper motor 40 to drive the take-up spool support 14. The operation of the labelling machine has therefore been described in the context of controller the stepper motor 40. It will be appreciated that in alternative embodiments of the invention a motor other than a stepper motor may be used to drive the take-up spool support 14. For example a DC-servo motor may be used. In such a case the controller will implement control logic similar to that described above, but modified to take into account the particular properties of the motor used.

Although preferred embodiments have been described above, it will be appreciated that various modifications can be made to the described embodiments without departing from the spirit and scope of the present invention.

The invention claimed is:

1. A labelling machine comprising a take up spool support for receiving a spool of web supporting a plurality of labels, the take up spool support comprising:

a platform configured to support components of the labelling machine a labelling machine spool support receiving a web supporting a plurality of labels, the spool support having a wall having an outer surface defining an opening for receipt of a portion of said web supporting said plurality of labels to be wound onto the spool support, the opening extending along at least part of the length of the wall, wherein the spool support has a first end attached to the platform and a second end distal the first end and a longitudinal axis from the first end to the second end; and an attachment member at least a portion of which is located radially inwards of the outer surface of the cylindrical wall and being moveable between a first position in which said portion of the web supporting said plurality of labels is secured to the support and a second position in which the portion of the web supporting said plurality of labels can be removed from the take up spool support;

an actuating knob at the second end of the spool support, coaxially aligned with the longitudinal axis of the spool support and operatively connected to the attachment member, wherein movement of the knob in a first direction causes movement of the attachment member to the first position and movement of the actuating knob in a second direction that is opposite to the first direction causes movement of the attachment member to the second position.

2. A labelling machine according to claim 1, wherein the wall is substantially cylindrical.

3. A labelling machine as claimed in claim 1, wherein the said portion of the web supporting said plurality of labels is trapped between the attachment member and the spool support when the attachment member is in the first position.

4. A labelling machine as claimed in claim 1, wherein, in the second position, the attachment member substantially closes the opening.

5. A labelling machine as claimed in claim 1, wherein the attachment member is moveable radially between said first and second positions.

6. A labelling machine as claimed in claim 1, wherein the take-up spool support further comprises an actuator member arranged to move said attachment member between said first and second positions.

7. A labelling machine as claimed in claim 6, wherein movement of the actuator member in a first direction causes movement of the attachment member in a second direction non-parallel to the first direction.

8. A labelling machine as claimed in claim 7, wherein the first and second directions are substantially perpendicular.

9. A labelling machine as claimed in claim 5, wherein the actuator member is moveable in a direction substantially parallel to that of the longitudinal axis of take up spool support.

10. The labelling machine of claim 1, wherein the spool support has a longitudinal axis through the free end thereof, and the spool support further comprising:

an actuator member extending in a direction substantially parallel to the longitudinal axis of take up spool support, the actuator member being arranged to move said attachment member between said first and second positions; and the actuating knob is fixedly attached to the actuating member, wherein movement of the actuator knob causes the actuating member to move in one direction, thereby causing movement of the attachment member in another direction, non-parallel to the direction of movement of the actuating member.

11. A labelling machine comprising:

a platform configured to support components of the labelling machine a supply spool support adapted to receive a supply spool of a web supporting a plurality of labels;

a take up spool support adapted to form a take-up spool including web from which at least some labels have been removed, a web path being defined between the supply spool and the take-up spool;

wherein the take up spool comprises:

a labelling machine spool support having a wall having an outer surface defining an opening for receipt of a portion of said web to be wound onto the spool support, the opening extending along at least part of the length of the wall, wherein the labelling machine spool support has a first end attached to the platform and a second end distal the first end and a longitudinal axis from the first end to the second end; and an attachment member at least a portion of which is located radially inwards of the outer surface of the cylindrical wall and being moveable between a first position in which said portion of the web is secured to the support and a second position in which the portion of the web can be removed from the take up spool support; and, an actuating knob at a free end of the spool support, coaxially aligned with the longitudinal axis of the spool support and operatively connected to the attachment member, wherein movement of the knob in a first direction causes movement of the attachment member to the first position and movement in a second direction that is opposite to the first direction causes movement of the attachment member to the second position.

12. The labelling machine of claim 11, wherein the spool support has a longitudinal axis through the free end thereof, and the spool support further comprising:

an actuator member extending in a direction substantially parallel to the longitudinal axis of take up spool support, the actuator member being arranged to move said attachment member between said first and second positions; and the actuating knob is fixedly attached to the actuating member, wherein movement of the actuator knob causes the actuating member to move in one direction, thereby causing movement of the attachment member in another direction, non-parallel to the direction of movement of the actuating member.

* * * * *